US006915099B2

(12) United States Patent
Izawa et al.

(10) Patent No.: US 6,915,099 B2
(45) Date of Patent: Jul. 5, 2005

(54) HEAT FIXING APPARATUS

(75) Inventors: Satoru Izawa, Shizuoka (JP); Hiroto Hasegawa, Shizuoka (JP); Akihito Kanamori, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 8 days.

(21) Appl. No.: 10/646,865

(22) Filed: Aug. 25, 2003

(65) Prior Publication Data

US 2004/0042827 A1 Mar. 4, 2004

(30) Foreign Application Priority Data

Aug. 28, 2002 (JP) ..... 2002-248307

(51) Int. Cl.[7] ..... G03G 15/20

(52) U.S. Cl. ..... 399/328; 399/67

(58) Field of Search ..... 399/38, 67, 68, 399/69, 320, 328, 329, 330; 219/216, 619

(56) References Cited

U.S. PATENT DOCUMENTS

| | | | | |
|---|---|---|---|---|
| 5,083,168 A | | 1/1992 | Kusaka et al. | 355/285 |
| 5,148,226 A | | 9/1992 | Setoriyama et al. | 355/290 |
| 5,149,941 A | | 9/1992 | Hirabayashi et al. | 219/216 |
| 5,162,634 A | | 11/1992 | Kusaka et al. | 219/216 |
| 5,210,579 A | | 5/1993 | Setoriyama et al. | 355/285 |
| 5,262,834 A | | 11/1993 | Kusaka et al. | 355/285 |
| 5,300,997 A | | 4/1994 | Hirabayashi et al. | 355/285 |
| 5,343,280 A | | 8/1994 | Hirabayashi et al. | 355/285 |
| 5,525,775 A | | 6/1996 | Setoriyama et al. | 219/216 |
| 5,682,576 A | | 10/1997 | Sakai et al. | 399/69 |
| 5,767,484 A | | 6/1998 | Hirabayashi et al. | 219/216 |
| 5,860,051 A | | 1/1999 | Goto et al. | 399/529 |
| 5,862,445 A | * | 1/1999 | Ogawa et al. | 399/329 |
| 5,920,757 A | | 7/1999 | Izawa et al. | 399/329 |
| 5,960,233 A | | 9/1999 | Goto et al. | 399/69 |
| 6,075,228 A | | 6/2000 | Goto et al. | 219/216 |
| 6,085,058 A | | 7/2000 | Goto et al. | 399/313 |
| 6,298,213 B1 | | 10/2001 | Miyamoto et al. | 399/320 |
| 6,347,211 B2 | | 2/2002 | Nanataki et al. | 399/328 |
| 6,493,521 B2 | | 12/2002 | Miyamoto et al. | 399/44 |
| 6,519,426 B2 | | 2/2003 | Goto et al. | 399/69 |
| 6,674,978 B1 | * | 1/2004 | Suzuki et al. | 399/67 |
| 6,728,498 B2 | * | 4/2004 | Takeuchi | 399/69 |
| 2002/0118977 A1 | | 8/2002 | Hasegawa et al. | 399/69 |
| 2002/0168202 A1 | | 11/2002 | Izawa et al. | 399/329 |
| 2003/0029853 A1 | | 2/2003 | Izawa et al. | 219/216 |
| 2003/0038125 A1 | | 2/2003 | Kataoka et al. | 219/216 |
| 2003/0118363 A1 | | 6/2003 | Izawa et al. | 399/69 |
| 2004/0013453 A1 | * | 1/2004 | Shinshi et al. | 399/328 |
| 2004/0037579 A1 | * | 2/2004 | Hashiguchi et al. | 399/67 |

FOREIGN PATENT DOCUMENTS

| | | |
|---|---|---|
| JP | 63-313182 | 12/1988 |
| JP | 2-157878 | 6/1990 |
| JP | 4-44075 | 2/1992 |
| JP | 4-44076 | 2/1992 |

(Continued)

*Primary Examiner*—Hoan Tran
(74) *Attorney, Agent, or Firm*—Fitzpatrick, Cella, Harper & Scinto

(57) ABSTRACT

A heat fixing apparatus, in which a recording material, with an unfixed image passes through a fixing nip formed by a fixing member and a pressurizing member, has an electro-conductive member to be in contact with the recording material disposed downstream of the fixing nip with respect to the recording material conveying direction, wherein a bias voltage is applied to at least one of the fixing member and the electro-conductive member. As recording materials are consecutively fed, the bias voltage applied while the recording materials pass through the fixing nip portion is gradually decreased in accordance with the number of heated recording materials. Thus, smeared image trailing edge upon fixing is prevented from occurring, and the amount of toner adhering to the surface of the fixing member or the surface of the pressurizing member is reduced, so that image errors such as toner contamination are prevented from occurring.

36 Claims, 7 Drawing Sheets

FOREIGN PATENT DOCUMENTS

| | | |
|---|---|---|
| JP | 4-44077 | 2/1992 |
| JP | 4-44078 | 2/1992 |
| JP | 4-44079 | 2/1992 |
| JP | 4-44080 | 2/1992 |
| JP | 4-44081 | 2/1992 |
| JP | 4-44082 | 2/1992 |
| JP | 4-44083 | 2/1992 |
| JP | 4-204980 | 7/1992 |
| JP | 4-204981 | 7/1992 |
| JP | 4-204982 | 7/1992 |
| JP | 4-204983 | 7/1992 |
| JP | 4-204984 | 7/1992 |

* cited by examiner

HEAT FIXING APPARATUS

BACKGROUND OF THE INVENTION

1. Field of the Invention

The present invention relates to a heat fixing apparatus for heat fixing an unfixed toner image corresponding to objective image information that is formed and borne on a recording material (i.e. transferring material, printing paper, photosensitive paper or electrostatic recording paper etc.) as a fixed image, in an image formation process part of an image forming apparatus using an image formation process such as an electrophotography process or an electrostatic recording process etc.

2. Description of Related Art

Conventionally, in fixing apparatus equipped in image forming apparatus using an electrophotography process, an electrostatic recording process or the like, so-called heat fixing apparatus have been widely used. The heat fixing apparatus is adapted to cause a recording material that bears an unfixed toner image to pass through a nip portion (i.e. a fixing nip portion) formed by a fixing roller and a pressure roller, which are rotating while being in pressure contact with each other, to fix the unfixed toner image on the recording material as a permanent image.

1) Heat Fixing Apparatus Using Heating Roller Scheme

An example of the conventional heat fixing apparatus is shown in FIG. 10. This heat fixing apparatus uses a heating roller scheme.

In FIG. 10, reference numeral 40 designates a fixing roller serving as a fixing means (or heating means). The fixing roller includes a halogen lamp 41 housed in a hollow metal core 42 made of aluminum having a thickness of about 0.5 to 4 mm so that it would have a satisfactory mechanical strength. The halogen lamp 41 is supplied with electrical power from a power source (not shown), so that heating sufficient for fusing toner on a recording material P would be performed from the interior of the hollow metal core 42.

In order to fix the toner on the recording material P without offset, a releasing layer 43 made of a material having a good releasability (or releasing property), such as polytetrafluoroethylene (PTFE) or perfluoroalkoxytetrafluoroethylene copolymer etc, is formed on the outer surface of the hollow metal core 42. The releasing layer 43 is formed in a tubular shape or applied by electrostatic spraying or dipping etc.

In some cases, an electro-conductive material such as carbon black is introduced into the releasing layer in order to prevent the offset that might occur in the case that the surface of the fixing roller is charged up upon conveying recording materials.

The hollow metal core 42 of the fixing roller 40 is electrically connected to earth or grounded via a diode element or applied with a bias by a bias applying means (not shown), so that generation of an offset image due to charging-up of the surface of the fixing roller is prevented from occurring.

In addition a thermistor in contact with the surface of the fixing roller 40 is provided. Thus, the temperature of the surface of the fixing roller is detected and the power supply to the halogen lamp 41 is controlled to be turned on and off in such a way that a toner image on a recording material is heated at an appropriate temperature.

On the other hand, reference numeral 50 designates a pressure roller serving as a pressurizing member, which is kept, by a pressing spring (not shown), in pressure contact with the above-mentioned fixing roller 40 at both end portions with respect to the longitudinal direction so as to hold and convey a recording material between them.

The pressure roller 50 is made by providing an elastic layer formed by molding a silicon rubber or a rubber foam elastic layer 52 formed by foaming a silicon rubber on the outer surface of a metal core 51 and further providing, on the outer surface of the elastic layer 52, a releasing layer 53 in the form of a tube or a coating made of PTFE, PFA or FEP etc. in a similar manner as the fixing roller.

With the elasticity of the pressure roller 50, a sufficient width of the nip can be formed between both the rollers 40 and 50. The toner image on the recording material P that is held and conveyed in the nip portion N is fixed by heat applied by the fixing roller 40.

2) Heat Fixing Apparatus Using Film Heating Scheme

Examples of the heat fixing method using a film heating scheme, in which power consumption is reduced as low as possible by not supplying electrical power to a heat fixing apparatus under a stand-by state, are disclosed in Japanese Patent Application Laid-Open No. 63-313182, Japanese Patent Application Laid-Open No. 2-157878, Japanese Patent Application Laid-Open No. 4-44075 and Japanese Patent Application Laid-Open No. 4-204980 etc. Specifically, in the heat fixing method using the film heating scheme, a toner image on a recording material is fixed via a thin film provided between a heater and a pressure roller.

FIG. 11 shows the outline of the structure of an example of the heat fixing apparatus using the film heating scheme. In the structure shown in FIG. 11, a fixing member 60 is mainly composed of a heating member (or a heating body, which will be referred to as a heater hereinafter) fixedly supported on a stay holder (a supporting member) 62 and a thin film (which will be referred to as a fixing film hereinafter) 63 having heat resisting properties loosely fitted over the stay holder 62. In order for a nip portion (i.e. a fixing nip portion) N having a predetermined nip width to be formed, a predetermined pressing force is generated between the fixing member 60 and an elastic pressure roller 50 serving as a pressurizing member by pressurizing means (not shown).

The heater 61 is composed of a ceramic substrate made of alumina and a resistance layer for generating heat with electric power and a protection layer, such as a glass layer or a polyimide layer, that are formed on the ceramic substrate. The heater 61 is heated by power supply to the resistance layer for generating heat with power supply, and the temperature of the heater 61 is controlled to a predetermined temperature by a temperature control system including temperature detection means 64 provided on the back side of the heater 61.

The fixing film 63 is a member in the form of a cylinder, a endless belt or a rolled web having ends that is to be conveyed by driving means (not shown) or by the rotational force of the pressure roller 50 to move in the direction indicated by an arrow while being in close and sliding contact with the surface of the heater 61 in the fixing nip portion N.

A recording material P serving as a material to be heated, on which an unfixed toner image is formed and borne, is introduced into the fixing nip portion N between the fixing film 63 and the pressure roller 50 under the state in which the heater is heated and controlled to a predetermined temperature and the fixing film is conveyed to be moved in the direction indicated by an arrow. Then, the recording material P is held and conveyed in the fixing portion N together with the fixing film 63 while being in close contact with the surface of the fixing film 63. In this fixing nip portion N, the recording material and the toner image are heated by the heater 61 via the fixing film 63, so that the toner image on the recording material P is heated and fixed. A portion of the recording material that have passed through the fixing nip portion N is detached from the surface of the fixing film 63 and conveyed further.

The fixing film 63 is designed to have a considerably small thickness of 20 to 70 μm in order to enable efficient transfer of heat supplied by the heater 61 to the recording material as the material to be heated in the fixing nip portion N. As shown in FIG. 12, the fixing film 63 has a three layer structure including a film base layer 63*a*, an electro-conductive primer layer 63*b* and a releasing layer 63*c* with the film base layer 63*a* facing the heater side and the releasing layer 63*c* facing the pressure roller 50 side.

The film base layer 63*a* is a resin film made of a highly insulative material such as polyimide, polyamide-imide or PEEK etc. or a thin metal film made of SUS or Ni etc. The film base layer 53*a* has heat resisting properties and a high elasticity with a thickness of about 15 to 60 μm, which ensures flexibility. The film base layer 63*a* ensures physical strength, such as tearing strength, of the fixing film 63 as a whole.

The electro-conductive primer layer 63*b* is formed as a thin layer with a thickness of about 2 to 6 μm. In order to prevent charging-up of the fixing film as a whole, the electrically conductive primer layer 63*b* is either electrically connected to earth or connected to a diode connection or bias applying means.

The releasing layer 63*c* is a layer for preventing the toner offset onto the fixing film 63. The releasing layer 63*c* is formed as a coating made of a fluorocarbon resin having a good releasing property such as PFA, PTFE, FEP or the like with a thickness of about 5 to 10 μm. In addition, in order to relieve charging-up of the surface of the fixing film 63 and to prevent the electrostatic offset, an electrically conductive material such as carbon black or the like having a resistivity of about $10^3$ to $10^6$ Ω.cm is added in the releasing layer.

The pressurizing member 50 has a structure similar to the pressure roller 50 of the above-described heat fixing apparatus using the fixing roller scheme.

In the heat fixing apparatus using the film heating scheme as described above, no electrical power is supplied to the heater 61 during a stand-by state, and it is possible to heat-fix an unfixed image on a recording material P by supplying electrical power to the heater to heat itself rapidly up to a temperature that enables fixing during the time from the image forming apparatus's receiving of a print signal to the arrival of a recording material P at the fixing nip portion N. Therefore, the heat fixing apparatus using the film heating scheme is an energy saving heat fixing apparatus.

However, recently the number of the types of recording materials has been increased and there is variety in the thickness, surface quality and resistance etc. of the recording materials. In connection with this, various problems concerning the image have occurred in the heat fixing process performed by a heat fixing apparatus in an image forming process. Those problems have been overcome by various structures.

For example, in the above-described conventional heat fixing apparatus, when a recording material enters the fixing nip portion, a phenomenon that the unfixed toner image on the recording material is scattered in the direction opposite to the recording material conveying direction sometimes occurs (this phenomenon will be referred to as "smeared image trailing edge upon fixing" hereinafter). The mechanism of generation of the smeared image trailing edge upon fixing will be described here with reference to FIG. 13. As shown in FIG. 13, moisture in the recording material is heated in the fixing nip portion N rapidly to evaporate, and toner T of the unfixed toner image on the recording material P in an area that has not entered the fixing nip yet is blown by the blow 80 of the generated vapor in the direction opposite to the recording material conveying direction, so that the smeared image trailing edge upon fixing is generated. This is an image error that is apt to occur under the condition that the moisture content of the recording material is high under high humidity environment, the image pattern includes horizontal lines with a large line width, and the toner amount of the unfixed toner image is large. In addition, it has been found that the degree of the smeared image trailing edge upon fixing has been deteriorated with the speeding-up of the image forming apparatus with which the blow 80 of the vapor generated from the recording material P is intensified.

An attempt to improve the smeared image trailing edge upon fixing will be described in the following. As shown in FIGS. 10 and 11, at a position downstream of the fixing nip portion N formed by the fixing member 40 or 60 and the pressure roller 50 as the pressurizing member with respect to the recording material conveying direction (the upstream side along the conveying direction is defined as the side closer to the starting point of the conveying), there is provided a rubber discharge roller 71 and a discharge roller 72 in a pair that hold and convey the recording material discharged from the fixing nip portion N between them. The rubber discharge roller 71 is made of an electro-conductive rubber material. The rubber discharge roller 71 is electrically grounded. Alternatively, an electro-conductive member in the form of a grounded brush-like member or the like is provided in the downstream of the fixing nip portion N with respect to the recording material conveying direction in such a way that the recording material P is in contact with the electro-conductive member while the recording material P is conveyed. On the other hand, in the above-described conventional apparatus, a bias having the polarity same as that of the unfixed toner image is applied to the hollow metal core 42 of the fixing roller 40 and the electro-conductive primer layer 63*b* of the fixing film 63 by bias applying means (not shown).

Thus, when the recording material is passing through the fixing nip portion N and in contact with the electro-conductive rubber discharge roller 71, a current path is formed via the recording material P, so that a voltage drop occurs between the fixing roller 40 or the fixing film 63 and the recording material P. This generates an electric field that intensifies retention of the unfixed toner image to the recording material P, and therefore the smeared image trailing edge upon fixing is prevented from occurring.

However, in the case that the speed of the image forming apparatus is increased, the smeared image trailing edge upon fixing is easy to occur, and in order to prevent the smeared image trailing edge upon fixing, it is necessary to increase the voltage drop generated between the fixing roller 40 or the fixing film 63 and the recording material P. Therefore, it is necessary to set a large bias value to be applied to the hollow metal core 42 of the fixing roller 40 or the electro-conductive primer layer 63*b* of the fixing film 63 and to supply the current path formed through the recording material P with a large current.

However, in the above-described structure in which the current path is formed between the hollow metal core 42 of the fixing roller 40 or the electro-conductive primer layer 63*b* of the fixing film 63 and the electro-conductive rubber discharge roller 71 via the recording material P, if an excessive current flows in the current path, an electric charge having the polarity reverse to the toner charge is injected into the toner at a position just after the fixing nip portion N, so that the polarity of the toner is reversed. Therefore, the toner is in a condition apt to adhere to the fixing roller 40 or the fixing film 63, which might cause toner contamination.

In the case of a low cost heat fixing apparatus that is not provided with particular cleaning means on the surface of the fixing roller 40 or the fixing film 63, the toner contamination gradually accumulates on the fixing roller 40, the fixing film 63 or the pressure roller 50 that is in contact with them, as the heat fixing apparatus performs the heat fixing process on a large number of recording materials. Then, the accumulated toner is sometimes discharged onto the recording material (this phenomenon will be referred to as blobs hereinafter) to cause an image error.

SUMMARY OF THE INVENTION

An object of the present invention is to provide the improvement of the smeared image trailing edge upon fixing in the above-described types of heat fixing apparatus and to reduce the amount of toner adhering to the surface of the fixing member to provide a heat fixing apparatus that would not generate image errors such as the blobs.

Another object of the present invention is to provide a heat fixing apparatus comprising a fixing member, a pressurizing member in pressure contact with the fixing member to form a fixing nip for holding and conveying a recording material on which an unfixed image has been formed so that the unfixed image formed on the recording material would be fixed as a permanent image, an electro conductive member to be in contact with the recording material disposed downstream of the fixing nip with respect to a recording material conveying direction, bias applying means for applying a variable bias voltage to at least one of the fixing member and the electro-conductive member, and bias control means that varies, in the case that recording materials on which unfixed images have been formed are consecutively fed, the bias voltage applied by the bias applying means gradually or stepwise while the recording materials are passing.

Preferably, in the case that a state in which feeding of a succeeding recording material has already been started by feeding means of an image forming apparatus at a time when a trailing edge of a preceding recording material passes the fixing nip portion continues, the bias control means determines that the recording materials are consecutively fed and decreases the bias voltage to be applied while the recording materials are passing gradually or stepwise.

Preferably, in an intervening period between the preceding recording material and the succeeding recording material during which the fixing member and the pressurizing member are in direct contact without a recording material between, the bias control means turns the bias voltage off.

Preferably, the bias applying means includes at least one of means for applying a bias voltage with polarity same as that of toner to an electro-conductive part of the fixing member and means for applying a bias voltage with polarity reverse to that of the toner to an electro-conductive part of the pressurizing member, at least one of the means being capable of varying the bias voltage, and an electric potential difference between the electro-conductive part of the fixing member and the electro-conductive part of the pressurizing member before a leading edge of the recording material comes into contact with the electro-conductive member disposed downstream of the fixing nip with respect to the recording material conveying direction is larger than the electric potential difference between the electro-conductive part of the fixing member and the electro-conductive part of the pressurizing member while the recording material is in contact with the electro-conducitve member.

Preferably, the pressurizing member has an electro-conductive part, to which a commutating element is connected so that the electro-conductive part would be kept to have polarity reverse to that of toner.

Preferably, an image forming apparatus is provided with environment detection means for detecting at least one of temperature and humidity of the operation environment, and the bias control means controls the bias voltage applied by the bias applying means based on a detection result of the environment detection means.

Preferably, an image forming apparatus is capable of setting a plurality of recording material conveying speeds, and the bias control means controls the bias voltage applied by the bias applying means in accordance with the recording material conveying speed that is set.

Preferably, an image forming apparatus is capable of setting a plurality of recording material conveying speeds, the bias applying means applies the bias voltage in such a way that an electric potential difference between an electro-conductive part of the fixing member and the electro-conductive member disposed downstream of the fixing nip is smaller when a low conveying speed is set than when a high conveying speed is set, and a decrement amount of the bias voltage, which is varied in accordance with the number of heated recording materials in the case that a state in which feeding of a succeeding recording material has been started by feeding means of the image forming apparatus when a trailing edge of a preceding recording material passes the fixing nip portion continues, is smaller when a low conveying speed is set than when a high conveying speed is set.

According to the present invention, upon heat fixing recording materials consecutively, in the early stage of the consecutive fixing in which smeared image trailing edge upon fixing is likely to occur, a current path is formed between a fixing member and an electro-conductive member disposed in the downstream of the fixing nip via a recording material, so that bounding force of the unfixed toner image on the recording material is enhanced by an electric field generated by voltage drop between an electro-conductive part of the fixing member and the recording material. Therefore, it is possible to prevent the smeared image trailing edge upon fixing from occurring. In addition, in the later stage of the consecutive fixing, the current amount flowing the above-mentioned current path is decreased by reduction of the fixing bias, so that contamination of the fixing member or a pressurizing member with toner due to toner offset that might occur if the toner charge polarity is reversed by charge injection into the toner just after the fixing nip due to excessive current flow. Thus, it is possible to realize a fixing apparatus in which the smeared image trailing edge upon fixing is prevented and the offset or film contamination do not occur, and to provide a heat fixing apparatus that can output a high quality fixed image at high speed.

DESCRIPTION OF THE PREFERRED EMBODIMENTS

First Embodiment (1) Example of Image Forming Apparatus

Figure 1:
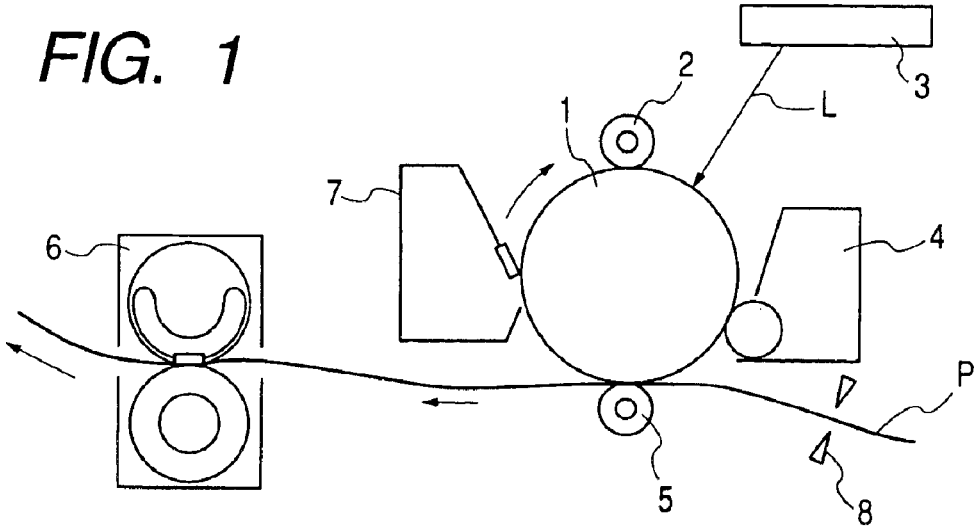
FIG. 1 is a drawing schematically showing the structure of an image forming apparatus in a first embodiment of the present invention.

FIG. 1 is a drawing schematically showing the structure of an image forming apparatus according to a first embodiment. This example of the image forming apparatus is a laser printer utilizing an electrophotography process.

Reference numeral 1 designates a photosensitive drum, in which a photosensitive material such as OPC, amorphous Se, or amorphous Si etc. is formed on a cylindrical substrate made of aluminum, nickel or the like.

The photosensitive drum 1 is driven to rotate in the direction indicated by an arrow, and its surface is first uniformly charged by a charging roller 2 serving as a charging apparatus.

Next, the uniformly charged surface of the rotary photosensitive drum 1 is subjected to laser beam scanning exposure L by a laser scanner unit 3, so that an electrostatic latent image corresponding to image information is formed. The laser beam scanning exposure L to the photosensitive drum 1 is performed by a laser beam that is controlled to be turned on and off in accordance with the image information and reflected by a polygon mirror rotating in the laser scanner unit 3. The electrostatic latent image is developed and visualized by a developing apparatus 4. The developing method may be jumping development (i.e. toner projection development), two-component development or FEED development etc, and a combination of image exposure and reversal processing is often used.

The visualized toner image is transferred, by means of a transferring roller 5 serving as a transferring apparatus, from the photosensitive drum 1 onto a recording material P that is conveyed from a sheet feeding mechanism (not shown) at a predetermined timing. In that process, a top sensor 8 detects the leading edge of the recording material P so that the timing would be adjusted in such a way that the image forming position of the toner image on the photosensitive drum 1 and the recording start position at the leading edge of the recording material coincide with each other. The recording material P that has been conveyed at a predetermined timing is held between the photosensitive drum 1 and the transferring roller 5 with a constant pressurizing force so as to be conveyed.

The recording material P on which the toner image has been transferred is conveyed to a heat fixing apparatus 6, in which the toner image is fixed as a permanent image.

On the other hand, residual toner remaining on the photosensitive drum 1 is removed from the surface of the photosensitive drum 1 by a cleaning apparatus 7.

(2) Heat Fixing Apparatus 6

Figure 2:
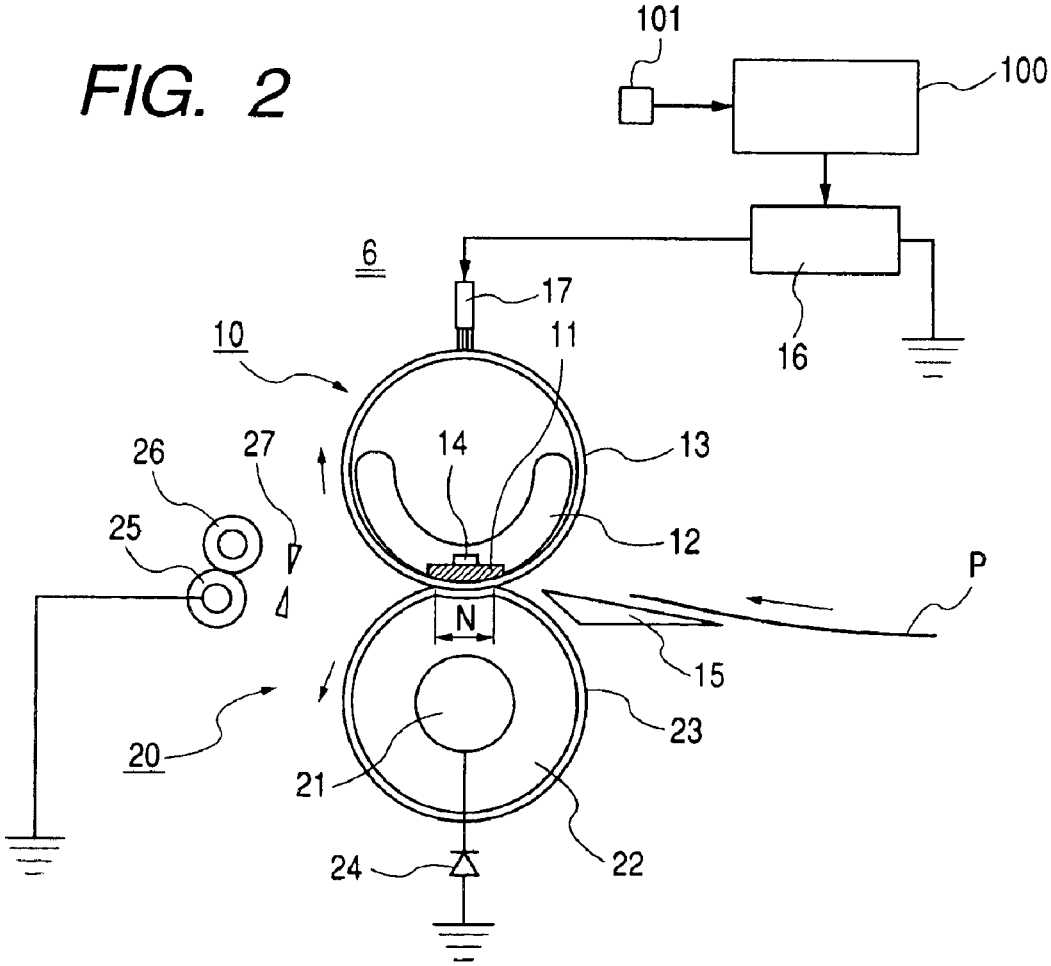
FIG. 2 is a drawing schematically showing the structure of a heat fixing apparatus in the first embodiment of the present invention.

FIG. 2 is a drawing schematically showing the structure of the heat fixing apparatus 6. The heat fixing apparatus 6 in this embodiment is a heating apparatus using a film heating scheme and a pressurizing rotating element driving scheme (tensionless type), which uses a cylindrical (in the form of an endless belt) flexible fixing film functioning as a moving member. Such apparatus are disclosed in Japanese Patent Application Laid-Open Nos. 4-44075 to 44083 and 4-204980 to 204984 etc.

1) Overall Structure of Heat Fixing Apparatus 6

Reference numeral 10 designates a fixing member (i.e. a fixing unit or a fixing film assembly) and reference numeral 20 designates an elastic pressure roller serving as a pressurizing member. These elements 10 and 20 are in pressure contact with each other to form a fixing nip portion N.

The fixing member 10 is a member whose longitudinal axis is perpendicular to the plane of the drawing sheet. The fixing member 10 is composed of a rigid stay holder (i.e. a supporting member) 12 having heat resisting properties and heat insulating properties with a transverse cross section of a substantially semicircular canaliculated shape, a ceramic heater 11 serving as a heating member fitted in a concave groove formed along on the bottom surface of the stay holder 12 along its longitudinal direction and fixed in it and a heat resisting flexible cylindrical fixing film 13 with a small heat capacity functioning as a moving member that is loosely fitted over the stay holder 12 to which the ceramic heater 11 is attached.

The stay holder 12 is a heat insulating member for holding the heater 11 and for preventing heat dissipation toward the direction opposite to the fixing nip portion N. The stay holder 12 is made of a heat resisting resin such as a liquid crystal polymer, a phenolic resin, PPS or PEEK etc. The stay holder 12 also functions as a guide member for rotation of the fixing film 13.

The elastic pressure roller 20 serving as the pressurizing member is composed of a metal core 21 made of a metal such as SUS, SUM, Al or the like and an elastic layer 22 formed on the outer surface of the metal core 21 with a heat resisting rubber such as silicon rubber or fluororubber etc. or foamed silicon rubber in which, preferably, an electroconductive material is dispersed. A releasing layer 23 made of PFA, PTFE, FEP or the like may be formed on the elastic layer 22.

The pressure roller 20 is pressed at both end portions with respect to its longitudinal direction toward the bottom surface of the heater 11 of the fixing member 10 by pressing means such as a pressing spring (not shown), so that the pressure roller 20 is sufficiently pressurized against the bottom surface of the heater 11 with the fixing film 13 between in order for the fixing nip portion N required for heat fixing to be formed.

The pressure roller 20 is rotationally driven by driving means (not shown) to rotate in the counterclockwise direction indicated by an arrow at a predetermined circumferential speed. By virtue of a pressure contact frictional force created by the rotational driving of the pressure roller 20 between the pressure roller 20 and the fixing film 13 at the fixing nip portion N, a rotational force is exerted on the cylindrical fixing film 13. Thus, the fixing film 13 is in a driven rotating state in the clockwise direction on the outer circumference of the stay holder 12 with its inner side being in contact with and sliding on the bottom surface of the heater 11.

A recording material P bearing an unfixed toner image is guided along a fixing entrance guide 15 having heat resisting properties and introduced into the fixing nip portion N between the fixing film 13 and the pressure roller 20 under the state in which the pressure roller 20 is rotationally driven, the cylindrical fixing film 13 is in the driven rotating state, the heater 11 is supplied with power, and the temperature of the heater 11 has been raised to a predetermined temperature and controlled. The recording material P is held and conveyed through the fixing nip portion N together with the fixing film 13 with the toner image bearing surface of the recording material P being in close contact with the outer surface of the fixing film 13 in the fixing nip portion N. In this holding and conveying process, heat of the heater 15 is given to the recording material P via the fixing film 13, so that the unfixed toner image on the recording material P is heated and pressed onto the recording material P so as to be fused and fixed.

Reference numeral 16 designates variable bias applying means for applying a fixing bias to the fixing film 13 via an electro-conductive brush 17. Reference numeral 24 designates a commutator such as a diode connected to the metal core 21 of the pressure roller 20.

Reference numerals 25 and 26 designate an electro-conductive rubber discharge roller and a discharge roller respectively, which constitute a roller pair for holding and conveying the recording material that has been discharged from the fixing nip portion N. The electro-conductive rubber discharge roller 25 is composed of a metal core made of a metal such as aluminum and a rubber layer formed on the metal core. The rubber layer is made of a heat resisting rubber such as a silicon rubber in which a material for giving electro-conductivity such as carbon black is dispersed, so that the electro-conductive rubber has electro-conductivity with a resistivity of $1\times10^6\Omega$ or less.

Reference numeral 27 designates a discharged paper sensor for detecting discharge of the recording material P from the fixing nip portion N.

Reference numeral 100 designates a control circuit part of the image forming apparatus, which controls the sequence of image forming operations of the image forming apparatus as a whole. The above-mentioned bias applying means 16 is controlled in accordance with a control program installed in this control circuit part 100 so that the fixing bias applied to the fixing film 13 would be appropriately set in accordance with conditions such as the number of the recording material that have been fed. This process will be specifically described later under items (3) and (4).

2) Heater 11 for Applying Heat

The heater 11 is formed by applying a resistance layer for generating heat with electric power made of an electro-conductive material such as Ag/Pd (i.e. silver palladium) Ni/Cr, $RuO_2$, $Ta_2N$ or $TaSiO_2$ and a matrix component such as glass or polyimide on a substrate having a high thermal conductivity made of a ceramic material such as AlN by screen printing, vapor deposition, spattering or metal plating or using a metal foil. The resistance layer for generating heat with electric power is formed on such surface of the substrate that is facing the fixing nip portion N or facing away from the fixing nip portion N. The resistance layer for generating heat with electric power is of a linear or band-like arcuate shape with a thickness of about 10 $\mu$m and a width of about 1 to 5 mm.

In addition, a insulative protecting layer made of a material having heat resisting properties such as polyimide, polyamide-imide, PEEK or glass is formed on the resistance layer for generating heat with electric power.

Furthermore, on the fixing nip side of the heater 11 that are to be in sliding contact with the fixing film 13, there may be provided a fluorocarbon resin layer such as polytetrafluoroethylene (PTFE), tetrafluoroethlene-perfluoroalkylvinylether copolymer (PFA), tetrafluoroethylene-hexafluoropropylene copolymer (FEP), ethylenetetrafluoroethylene copolymer (ETFE), polychlorotrifluoroethylene (CTFE) or polyvinylidenefluoride (PVDF) etc. or a mixture thereof formed by coating, or a sliding layer formed by applying or vapor-depositing a dry coating lubricant made of graphite or molybdenum disulfide etc. or glass, diamond-like carbon (DLC) with a small thickness. This enables smooth sliding with a small coefficient of friction between the fixing film and the heater for applying heat. Alternatively, the heater 11 may be designed in such a way as to make the roughness of the surface of the substrate having a high thermal conductivity that is to be in sliding contact with the fixing film lower than a predetermined degree and to ensure slidability by a lubricative grease or the like so as to make the thermal resistance low and to enhance the thermal efficiency.

The heater for applying heat 11 is rapidly heated by heat generated by power supply to the resistance layer for generating heat with electric power, and the temperature rise of the heater 11 is detected by a temperature detection element 14, so that the power supply to the resistance layer for generating heat with electric power is controlled by a temperature control system including the temperature detection element 14 and the fixing temperature is controlled to be a predetermined temperature.

3) Fixing Film 13

Figure 3:
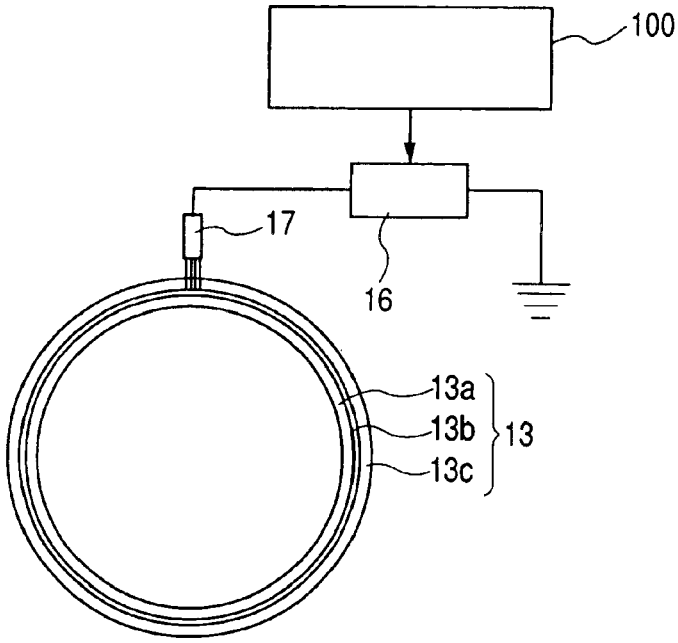
FIG. 3 is a drawing schematically showing the layer structure of a fixing film and bias applying means in the first embodiment of the present invention.

The fixing film 13 is a flexible member having a small heat capacity, and it is a heat resisting film with a total thickness less than 100 $\mu$m that enables quick-starting. As shown in FIG. 3, the fixing film 13 has a base layer 13*a* made of a heat resisting resin such as polyimide, polyamide-imide or PEEK or a metal material having heat resisting properties and a high thermal conductivity such as SUS, Al, Ni, Ti or Zn or a mixture thereof.

In the case that the base layer 13*a* is made of a resin, powder of a material having a high thermal conductivity such as BN, alumina or Al may be added in order to enhance thermal conductivity.

In order for the base layer 13*a* to have a strength and durability that ensure a long operating time of the fixing film 13, it is necessary for the base layer 13*a* to have a total thickness more than 20 $\mu$m. Therefore, the optimum total thickness of the fixing film is 20 to 100 $\mu$m.

Furthermore, in order to prevent the offset or to ensure releasability of recording materials, coating of a heat resisting resin having a good releasability such as a fluorocarbon resin, e.g. polytetrafluoroethylene (PTFE), tetrafluoroethlene-perfluoroalkylvinylether copolymer (PFA), tetrafluoroethylene-hexafluoropropylene copolymer (FEP), ethylenetetrafluoroethylene copolymer (ETFE), polychlorotrifluoroethylene (CTFE) or polyvinylidenefluoride (PVDF) etc, or a silicone resin or their mixture is applied as a releasing layer 13*c*.

In the releasing layer 13*c*, an electro-conductive material such as carbon black or an ionic conductive material etc. is mixed, and the releasing layer 13*c* has a resistivity of about $1\times10^{7}$ to $1\times10^{14}$ Ω·cm. The releasing layer is formed as a coating with a thickness of about 5 to 20 μm. The coating is formed by, for example, applying the electro-conducting primer layer 13*b* serving as an adhesive on the outer surface of the base layer 13*a* and then applying the releasing layer 13*c*. At least one of the base layer 13*a* and the primer layer 13*b* is made of an electro-conductive material. In the electro-conductive primer layer 13*b*, a material for giving electro-conductivity such as carbon black is dispersed, so that the electro-conductive primer layer has an resistivity equal to or less than $1\times10^{5}$ Ω·cm and a thickness of about 2 to 10 μm.

The above-mentioned electro-conductive brush 17 is adapted to be in contact with the electro-conductive primer layer of the fixing film 13, so that it is possible to apply a predetermined voltage with the polarity same as the unfixed toner from the above-mentioned variable bias applying means to the electro-conductive primer layer (or fixing film electro-conductive layer) of the fixing film 13 via the electro-conductive brush 17 in accordance with conditions such as the number of recording materials that have been fed.

(3) Features Concerning Fixing Bias Control

The metal core of the above-mentioned electro-conductive rubber discharge roller 25 is in an electrically grounded state so as to form a predetermined electric potential difference with the voltage applied to the electro-conductive primer layer 13*b* of the fixing film 13 by the bias applying means 16 via the electro-conductive brush 17. Thus, a current path is formed between the rubber discharge roller 25 and the electro-conductive primer layer of the fixing film 13, as long as the recording material P is in contact with the fixing nip portion N and the rubber discharge roller 25.

In this embodiment, the description is made with reference to the electro-conductive rubber discharge roller 25, but the electro-conductive member to be in contact with the recording material may be of any form (e.g. an electro-conductive brush or an electro-conductive guide etc.) as long as it creates an electric potential difference with the electro-conductive primer layer of the fixing film 13 to form a current path via a recording material.

The metal core 21 of the pressure roller may be constructed in such a way that a charge with the polarity reverse to the toner is induced in the metal core 21 of the pressure roller or the electro-conductive elastic layer 22 by a commutating element 24 such as a diode.

During the heat fixing of a recording material P in the fixing nip portion N, the control circuit part 100 controls the bias applying means 16 to apply a certain fixing bias to the electro-conductive primer layer 13*b* of the fixing film 13 based on a signal from the top sensor 8 for detecting the leading edge position of the recording material P and a signal from the discharged paper sensor 27.

Figure 4:
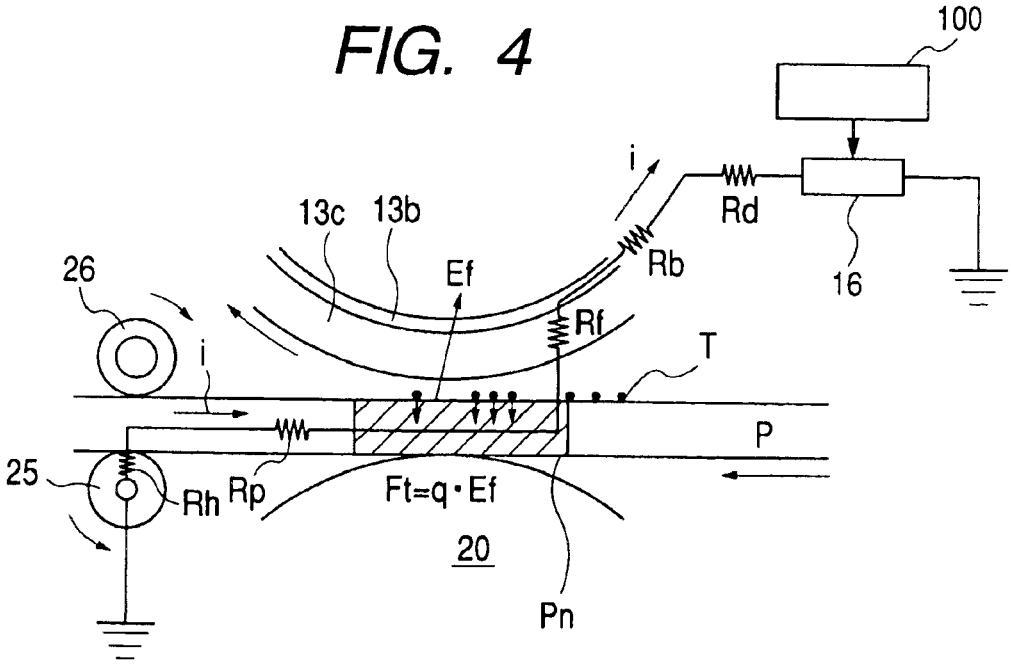
FIG. 4 is an equivalent circuit diagram of a fixing nip portion and related portions.

FIG. 4 is a drawing for illustrating the fixing bias control of the fixing apparatus according to the present embodiment. FIG. 4 is an example of an equivalent circuit of the system under the state in which a recording material P on which unfixed toner T has been transferred is in the fixing nip portion N and a DC bias with the polarity same as the toner is applied to the electro-conductive primer layer 13*b* of the fixing film 13 by the bias applying means 16.

The application of the bias to the electro-conductive primer layer 13*b* of the fixing film 13 is performed by causing the electro-conductive brush 17 as shown in FIGS. 2 and 3 or a power supplying member such as a electro-conductive rubber ring (not shown) to be in contact with the electro-conductive primer layer 13*b*. A resistance Rd serving as a protecting resistance is connected between the output terminal of the bias applying means and the electro-conductive primer layer 13*b*. In the equivalent circuit, Rb represents the contact resistance between the above-mentioned power supply member 17 and the electro-conductive primer layer 13*b* and the resistance of the electro-conductive primer layer 13*b* in the area extending to the vicinity of the fixing nip portion N. Rf represents the resistance of the releasing layer 13*c* of the fixing film 13.

In the area Pn in the vicinity of the fixing nip portion N, the recording material P such as a paper sheet is heated and vapor is generated. Therefore, the electric resistance of that portion Pn is decreased to a value that is negligible in the equivalent circuit as compared to other resistances that are connected in series, and therefore the area Pn can be regarded as equipotential.

In the paper that has passed through the fixing portion, the moisture content has been decreased and its resistance cannot be neglected. Therefore, the resistance of the portion of the recording material P from the fixing nip portion to the rubber discharge roller 25 is represented by Rp.

In addition, the contact resistance of the rubber discharge roller 25 serving as an earth electrode and the recording material P and the resistance of the portion from the rubber discharge roller 25 to the earth is represented by Rh.

In the above-described equivalent circuit, when a bias V is applied to the electro-conductive primer layer 13*b* of the fixing film 13 by the bias applying means 16, the electric potential of a portion in the electro-conductive primer layer 13*b* of the fixing film 13 in the vicinity of the fixing nip portion becomes a potential Vn that is a little lower than the applied bias V due to a voltage drop through resistance Rd and resistance Rb.

In addition, a current i flows between the electric potential Vn of the electro-conductive primer layer 13*b* of the fixing film 13 and the earth potential V0 via the releasing layer 13*c*, the recording material P and the rubber discharge roller 25 serving as the earth electrode. As a result, an electric field Ef is generated between the electro-conductive primer layer 13*b* and the equipotential portion Pn of the recording material P. By virtue of this electric field, the unfixed toner image receives a bounding force Ft=q·Ef proportional to the charge q of the toner that bounds or constrains the toner to the recording material P. Thus, it is possible to prevent image errors such as the above-mentioned smeared image trailing edge upon fixing and scattering.

In the case of consecutive printing in which the image forming apparatus receives print signals and heat-fixes unfixed toner images consecutively, especially upon heat fixing in the early stage of the consecutive printing in which vapor is not in a saturated state, the resistance Rp just after the heat fixing of a recording material, which has been conveyed from the transferring section to the fixing section, is large, since the vapor in the vicinity of the fixing nip portion is not in a saturated state in spite that the recording material emit vapor in the fixing nip portion. Therefore, a current is difficult to flow in the area from the electro-conductive primer layer 13*b* of the fixing film 13 to the rubber discharge roller 25 serving as the earth electrode.

Here, the consecutive printing implies the case in which the image forming apparatus does not stop and recording materials each having a limited length are sequentially conveyed to the image forming section and the heat fixing section by feeding means. Specifically, it means the case in which when the trailing edge of the preceding recording material passes the fixing nip portion N or the discharged paper sensor 27 of the heat fixing apparatus shown in FIG. 2, the feeding of the next (i.e. succeeding) recording material from the recording material feeding means of the image forming apparatus has been started.

On the other hand, when a succeeding recording material in the consecutive heat fixing is fed, the neighborhood of the fixing nip portion is in a state full of vapor due to vapor emitted from the recording material(s) that has been precedently fed. Especially, the amount of vapor increases as the number of recording materials that have been consecutively fed increases. Therefore, in the later stage of the consecutive feeding, a current is easy to flow from the electro-conductive primer layer 13*b* of the fixing film 13 to the rubber discharge roller 25 serving as the earth electrode. In addition, since the amount of vapor in the neighborhood of the fixing nip portion is small in the early stage of the consecutive feeding, the air pressure in the area before the fixing nip portion is low. Therefore, the vapor generated in the fixing nip portion is apt to be strongly discharged to the area before the fixing nip portion.

Due to the above-described facts, in the case in which the bias voltage V applied by the bias applying means 16 is constant, the smeared image trailing edge upon fixing is easy to occur in the early stage of the consecutive printing, while the smeared image trailing edge upon fixing is decreased in the later stage of the consecutive printing.

Since the temperature of the fixing nip portion N is high, vapor filling its circumference is difficult to become water droplet in the vicinity of the fixing nip portion N. Especially, in the case that a fan or the like for cooling the interior is provided in the image forming apparatus, the vapor is discharged to the exterior of the apparatus by airflow in a few seconds. Therefore, in the case that there is a significant interval between recording materials that are fed, the condition of the neighborhood of the fixing nip portion is returned to the condition same as the early stage of the consecutive printing.

Due to the above-described facts, if the bias applied to the electro-conductive primer layer 13*b* of the fixing film 13 is set to a large value with a view to generate a required current amount, occurrence of a smeared image trailing edge upon fixing can be suppressed. However, in the case that the applied bias is large, an excessive current will flow from the rubber discharge roller 25 serving as the earth electrode to the electro-conductive primer layer 13*b* of the fixing film 13, especially in the later stage of the consecutive printing, so that electric charge is given to the toner just after the fixing nip portion and potential reversal occurs with regard to the potential of the portion before the fixing nip portion. Thus, problems such as offset of the toner image from the recording material to the surface of the fixing film will occur. Especially in the case that the consecutive printing continues and the amount of transfer of the toner image to the fixing film becomes large, toner contamination accumulates on the fixing film 13 or on the pressure roller 20, on which toner is transferred from the fixing film 13 during intervals of the feeding of recording materials (i.e. during the intervening period between sheets). The accumulated toner is eventually discharged to generate an image error.

In view of this, in the present embodiment, in the case that recording materials are consecutively heat-fixed, the bias voltage generated by the bias applying means 16 is decreased depending on the number of the recording materials that are consecutively fed so that the electric potential difference between the electro-conductive primer layer 13*b* of the fixing film 13 and the rubber discharge roller 25 serving as the earth electrode would be gradually decreased in accordance with the number of the consecutively printed recording materials.

Figure 5:
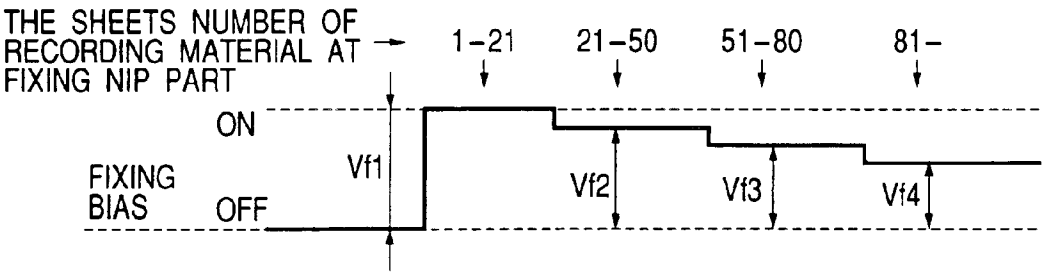
FIG. 5 is a fixing bias timing chart (part 1) in the first embodiment of the present invention.

FIG. 5 is a timing chart of the bias application in this embodiment. In FIG. 5, the bias voltage is successively decreased stepwise in accordance with the sheet number of recording material that is held and conveyed in the fixing nip portion under consecutive printing as follows:

1) for first to 20th sheets, the bias value applied to the electro-conductive primer layer 13*b* of the fixing film 13 is set to Vf1;

2) for 21st to 50th sheets, the bias value is set to Vf2;

3) for 51st to 80th sheets, the bias value is set to Vf3; and 4) for 81st and succeeding sheets, the bias value is set to Vf4.

If a bias with the polarity same as the toner is applied to the fixing film 13 during a period in which the fixing film 13 is in direct contact with the pressure roller 20 without a recording medium between them in the fixing nip portion, that is, for example during a prior rotation period (i.e. the period in which the image forming apparatus is performing a pre-printing operation), a sheet interval period or a posterior rotation period (i.e. the period in which the image forming apparatus is performing a post-printing operation), a small amount of offset adhering on the fixing film is apt to be electro-statically transferred onto the pressure roller 20 for example in the sheet interval period. The toner adhering to the pressure roller is difficult to be transferred to recording materials, and the toner is accumulated on the pressure roller. When the amount of thus accumulated toner becomes large, it is sometimes discharged onto a recording sheet with a visible size.

Figure 6:
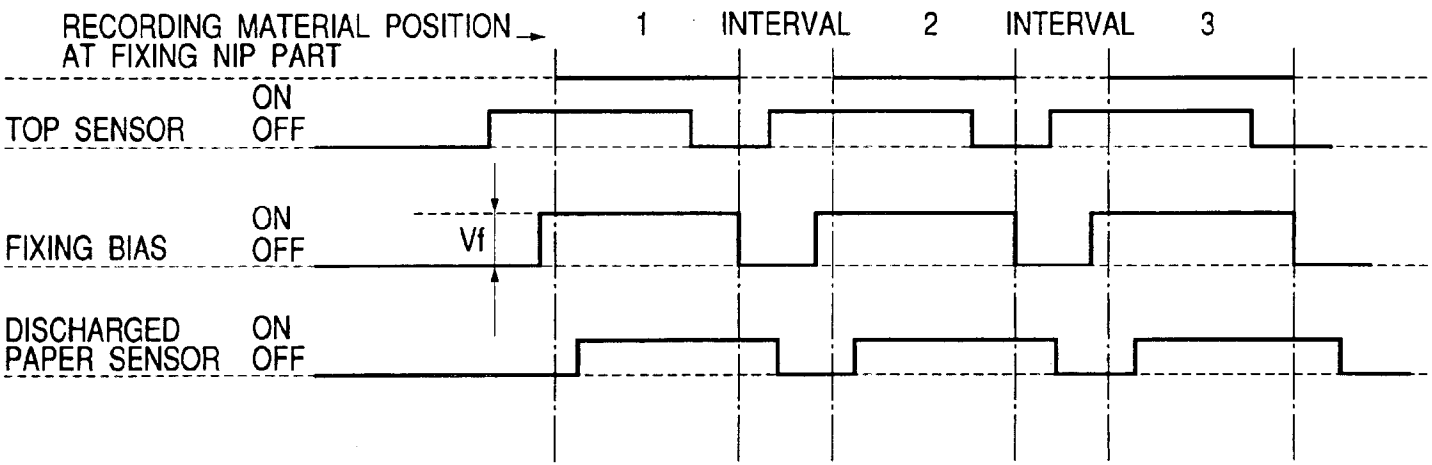
FIG. 6 is a fixing bias timing chart (part 2) in the first embodiment of the present invention.

In order to prevent this, it is preferable that the fixing bias be applied substantially only while a recording material is held and conveyed in the fixing nip portion as shown in FIG. 6. Specifically, in FIG. 6, the periods in which recording materials are held and conveyed in the fixing nip portion are indicated by thick line segments, and the sensing timing of the top sensor 8, the sensing timing of the discharged paper sensor and the timing of bias application are shown in relation to the timing of those periods. In connection with the sensors, "ON" in FIG. 6 means that a recording material is present in the respective sensor parts.

As will be seen from FIG. 6, the timing of the application of the bias to the electro-conductive primer layer 13*b* of the fixing film 13 is determined in such away that the bias application by the bias applying means is started when time T1 that is obtained by dividing the distance from the position where the top sensor is ON to the fixing nip portion N by the sheet conveying speed or a time a little shorter than said time T1 has elapsed after detection of the leading edge of the recording material P by the top sensor 8.

In addition, as to the timing for turning the fixing bias off is determined in such a way that the bias application by the bias applying means is turned off when time T2 that is obtained by dividing the distance from the position where the top sensor is OFF to the fixing nip portion N by the sheet conveying speed has elapsed after detection of the trailing edge of the recording sheet by the top sensor 8.

Referring to the value of the fixing bias, while a recording material is held and conveyed in the fixing nip portion N, a fixing bias of a value Vf having the polarity same as the toner is applied to the electro-conductive primer layer of the fixing film 13. By decreasing the value Vf gradually depending on the number of recording materials that have been fed in the consecutive printing, charge imparted to the toner on the recording material just after the fixing is reduced and the smeared image trailing edge upon fixing is prevented.

The consecutive printing was defined before, and in the case that a succeeding recording material is not fed into the image forming apparatus by the feeding means when the trailing edge of the preceding recording material passes the discharged paper sensor after passing through the fixing nip, it is determined that the consecutive printing has ended. Therefore, when the image forming apparatus receives a print signal again and the feeding of a recording material is started, the bias setting is returned to the initial state.

(4) Confirmation of Effects

In order to confirm effects of the embodiment, the following experiments were performed.

1) The image forming apparatus (FIG. 1) used in the experiments was a laser beam printer with a recording material conveying speed of 250 mm/sec. The fixing apparatus thereof was of a type in which toner was negatively charged (i.e. charged with the minus polarity) and a toner image was formed on a photosensitive drum by jumping development, so that an image was formed on a recording material by a transferring roller.

2) In the fixing apparatus (FIGS. 2 and 3), the above-described fixing film 13 was composed of a base layer 13*a* in the form of a cylinder made of SUS304 with an outer diameter of 30 mm and a thickness of 40 $\mu$m, a electro-conductive primer layer 13*b* applied on the outer surface of the base layer with a thickness of 4 $\mu$m, and a releasing layer 13*c* made of PFA in which an electro-conductive material was dispersed that was further formed with a thickness of 10 $\mu$m. The resistivity of the releasing layer was $1\times10^9$ $\Omega\cdot$cm.

In addition, the pressure roller 20 was composed of a metal core 21 made of aluminum with an outer diameter of 22 mm, an elastic layer 22 made of an electro-conductive silicon rubber with a thickness of 4 mm and an outer diameter of 30 mm formed on the metal core, and an outer layer 23 in the form of a PFA insulative tube with a thickness of 40 $\mu$m.

3) In the experiments, a bias with the polarity same as the toner was applied to the electro-conductive primer layer 13*b* of the fixing film 13, and comparative evaluations on the levels (or the degree) of the smeared image trailing edges upon fixing were performed while changing the value of the bias depending on the number of heat-fixed recording materials in the consecutive printing. In addition, the amount of toner adhering to or accumulated on the surface of the fixing film and the surface of the pressure roller was also observed and compared.

As to the smeared image trailing edge upon fixing, the comparative evaluation of the level was performed on every first recording material after the bias was changed in accordance with the respective number of the recording materials (namely, the comparative evaluations were performed on the levels of the first, 21st, 51st and 81st recording materials). As to the toner amount, consecutive feeding of 500 sheets from a feeding cassette accommodating 500 sheets was defined as one job, and the comparative evaluation on the accumulation of toner contamination on the fixing film and the pressure roller was performed for twenty consecutive jobs with one minute intervals between the jobs.

As to the fixing bias, since a sheet number counter was returned to the initial state when the operation of the apparatus was stopped, the value of the bias applied by the bias applying means 16 was returned to the initial state. Therefore, the bias values were applied in the same manner for respective jobs each of which included 500 sheets.

4) The values of the biases for the respective sheet number segments in experiments 1 to 3 (Exp. 1 to Exp. 3) are shown in Table 1.

TABLE 1

| Sheet Number | 1 to 20 | 21 to 50 | 51 to 80 | 81 to 500 |
|---|---|---|---|---|
| Exp. 1 | −1000 V | −1000 V | −1000 V | −1000 V |
| Exp. 2 | −1000 V | −800 V | −600 V | −500 V |
| Exp. 3 | −1000 V | −700 V | −400 V | −200 V |

5) The results of comparative evaluations on the smeared image trailing edge upon fixing and the toner contamination are shown in Table 2. In Table 2, the numerical values represent the ranks, in which rank 5 represents a level at which no problem exists, rank 4 represents a level at which the smeared image trailing edge or the toner contamination is generated to a small extent, rank 3 represents an acceptable level, rank 2 represents a failed level at which a problem occurs, and rank 1 represents a very poor level. (These rank representations will also be used in later Tables 5, 7 and 10). The evaluations of the smeared image trailing edge were performed on the substantially central position on the recording materials.

TABLE 2

| | Results of Comparison on Smeared Image Trailing Edge | | | | Results of Comparison on |
|---|---|---|---|---|---|
| Sheet Number | first sheet | 21st sheet | 51st sheet | 81st sheet | Toner Contamination |
| Exp. 1 | 3 | 4 | 4 | 5 | 1 |
| Exp. 2 | 3 | 4 | 4 | 3 | 3 |
| Exp. 3 | 3 | 3 | 2 | 1 | 5 |

As seen from the above results, in experiment 1 in which the fixing bias value in the consecutive printing was kept at −1000V without variation, the level of the smeared image trailing edge upon fixing was relatively good, but there was a problem with respect to the toner contamination and toner contamination was observed on recording materials in tenth and succeeding jobs.

On the other hand, in experiment 3 in which the bias was greatly decreased, no toner contamination occurred, but very poor level smeared image trailing edges upon fixing occurred a certain sheet and the succeeding sheets. In view of these results, it is possible to prevent the toner contamination while realizing a satisfactory level in the smeared image trailing edge upon fixing by gradually decreasing (or decrementing) the fixing bias value in the consecutive printing to a moderate extent.

6) In this embodiment, the description has been made in connection with the system in which a bias with the polarity same as the toner is applied only to the electro-conductive primer layer 13*b* of the fixing film. However, the system may be modified in such a way that a bias with the polarity reverse to the toner is applied by another bias applying means to an electro-conductive member that is adapted to be in contact with a electro-conductive layer of the pressure roller and a recording material positioned on the downstream side of the fixing nip, as will be described below.

Figure 7:
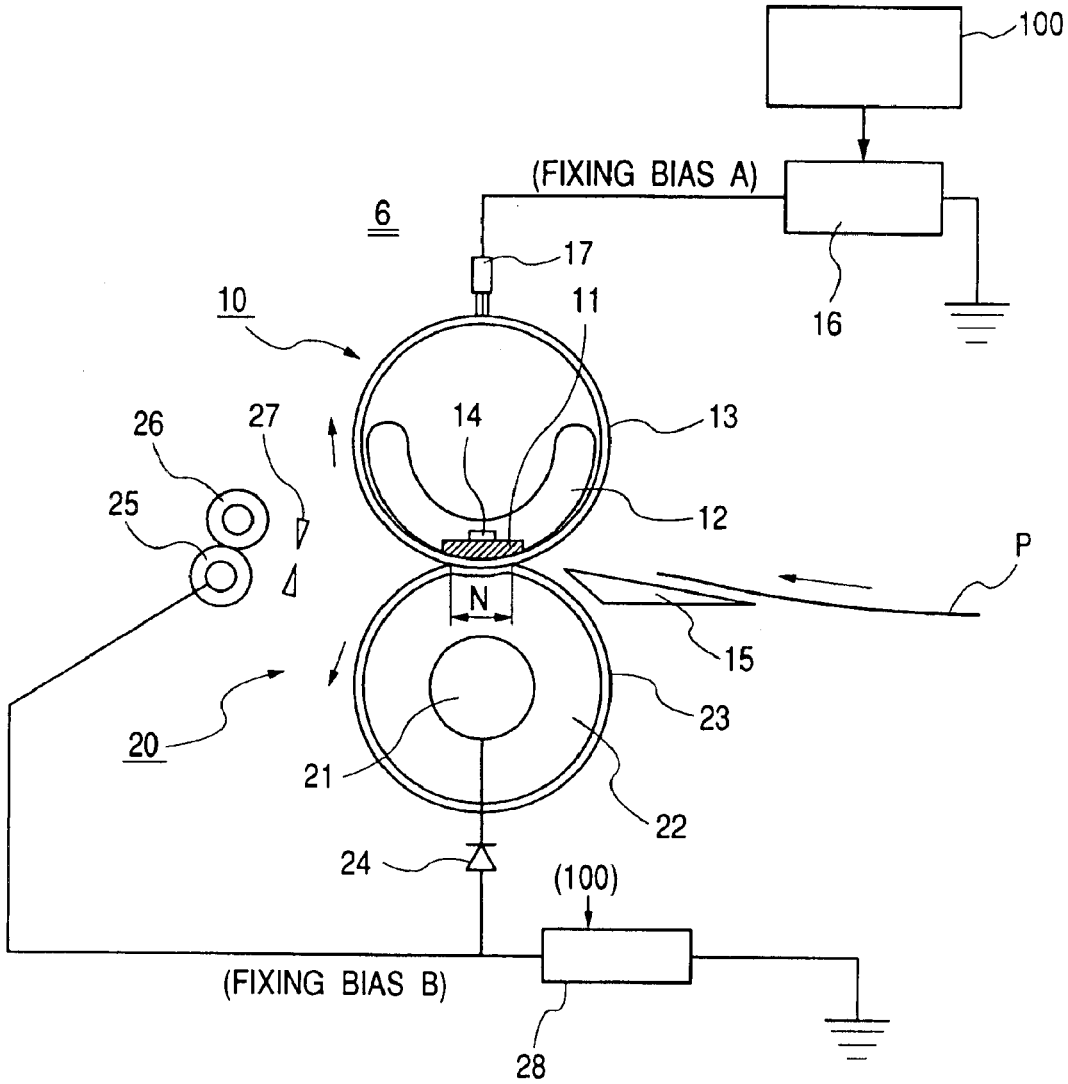
FIG. 7 is a drawing schematically showing an alternative heat fixing apparatus in the first embodiment of the present invention.

In the structure shown in FIG. 7, the pressure roller 20 includes the metal core 21 made of a metal, the electro-conductive elastic layer 22 made of a silicon rubber etc. in which an electro-conductive material such as carbon is dispersed formed on the metal core 21 and the releasing layer 23 in the form of a heat resisting tube having insulating properties made of PFA or the like provided on the outer periphery of the elastic layer 22. Second bias applying means 28 is connected to the metal core 21 of the pressure roller.

In addition, it is preferable that a commutating element such as a diode be inserted between the second bias applying means 28 and the metal core of the pressure roller 21.

Furthermore, the apparatus may be constructed in such a way that the second bias applying means 28 applies a bias (fixing bias B) with the polarity reverse to the toner to the metal core 21 of the pressure roller and also applies, at the same time, a bias to the metal core of the electro-conductive rubber discharge roller 25 disposed in the downstream of the fixing nip. In connection with this, the applied voltages, or the values of the bias applied to the metal core of the pressure roller and the value of the bias applied to the electro-conductive rubber discharge roller may be different from each other. In addition, the bias applying means 28 may be separately provided for the respective members to which the biases are to be applied.

With the above-described structure, a bias (fixing bias A) with the polarity same as the toner is applied to the electro-conductive primer layer 13*b* of the fixing film 13 by the first bias applying means, while a bias (fixing bias B) with the polarity reverse to the toner is applied to the metal core of the pressure roller 20 and the metal core of the rubber discharge roller 25 by the second bias applying means 28.

Figure 8:
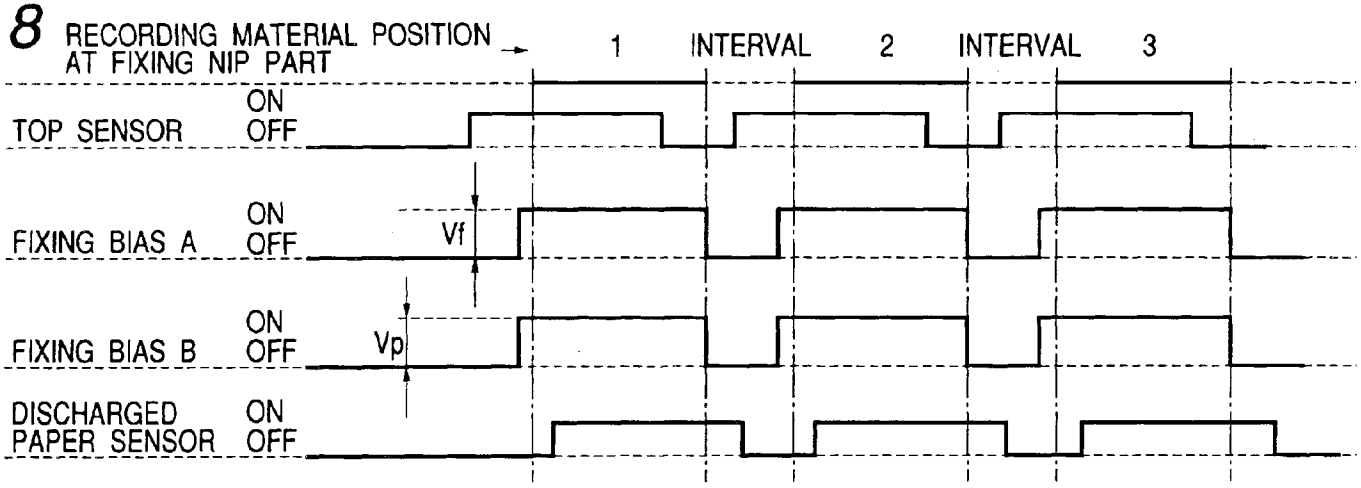
FIG. 8 is a fixing bias timing chart (part 3) in the first embodiment of the present invention.

FIG. 8 is a timing chart of the bias application. In FIG. 8, fixing bias A is the bias applied to the electro-conductive primer layer 13*b* of the fixing film 13 by the first bias applying means 16, wherein a bias value Vf with the polarity same as the toner is applied while a recording material is held and conveyed in the fixing nip. On the other hand fixing bias B indicates the bias applied to the metal core 21 of the pressure roller 20 and to the electro-conductive rubber discharge roller 25 disposed in the downstream of the fixing nip by the second bias applying means. Thus, a bias value Vp is applied to the metal core 21 of the pressure roller and to the electro-conductive rubber discharge roller 25.

As shown in FIG. 8, the bias application timing is such that the fixing bias A and the fixing bias B are applied at the same time when a predetermined time has elapsed after detection of the leading edge of the recording material by the top sensor 8. The value of the respective biases are Vf and Vp, where the value Vf is applied with the polarity same as the toner, while the value Vp is applied with the polarity reverse to the toner. Those biases are lowered to be at off level at the time when the recording material is discharged from the fixing nip, more specifically, when a predetermined time has elapsed after detection of the trailing edge of the recording material by the top sensor 8.

At least one of the bias value Vf and the bias value Vp is a variable bias, so that the electric potential difference between the electro-conductive primer layer 13*b* of the fixing film 13 and the metal core 21 of the pressure roller 20 or the electro-conductive rubber discharge roller 25 is gradually decreased. Thus, it is possible to realize the effect of improving the smeared image trailing edge upon fixing and preventing the toner contamination as mentioned above.

In the case that a bias with the polarity reverse to the toner is applied to the pressure roller 20 and the electro-conductive member in the downstream of the fixing nip, it is apparent that the same effect can be obtained even if the electro-conductive primer layer 13*b* of the fixing film is in an electrically grounded state.

Second Embodiment

In the following, a second embodiment will be described. The overall structure of the image forming apparatus is the same as the structure shown in FIG. 1 that has been described in connection with the first embodiment, and the structure of the heat fixing apparatus is the same as the structure shown in FIGS. 2, 3 and 4 that has been described in connection with the first embodiment. Therefore, description thereof will be omitted.

A characterizing feature of the second embodiment resides in that under the state in which the leading edge of a recording material is held in the fixing nip portion N and the leading edge of the recording material has not reached the electro-conductive member 25 disposed in the downstream of the fixing nip portion, the electric potential difference between the electro-conductive primer layer 13*b* and the electro-conductive elastic layer of the pressure roller is set to be large so as to prevent the smeared image trailing edge upon fixing from occurring in the leading edge portion of the recording material.

Figure 9:
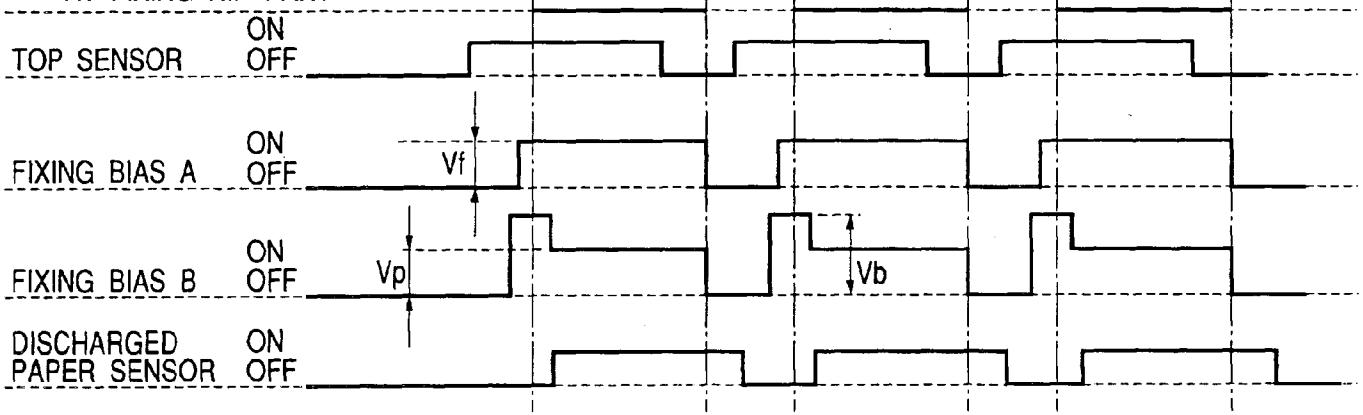
FIG. 9 is a fixing bias timing chart in the second embodiment of the present invention.
Figure 10:
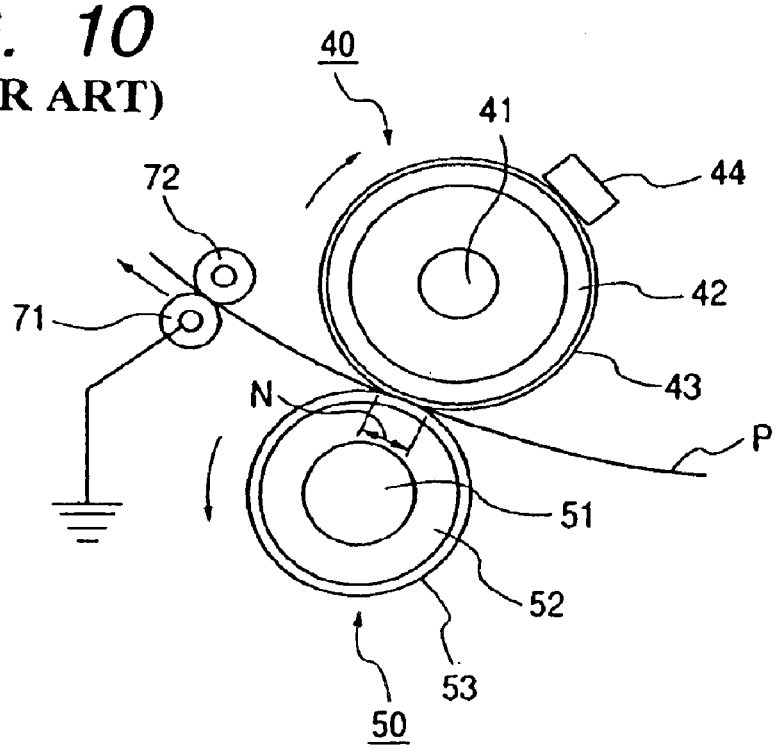
FIG. 10 (PRIOR ART)
FIG. 10 is a drawing schematically showing a conventional fixing apparatus (using a heating roller scheme).
Figure 11:
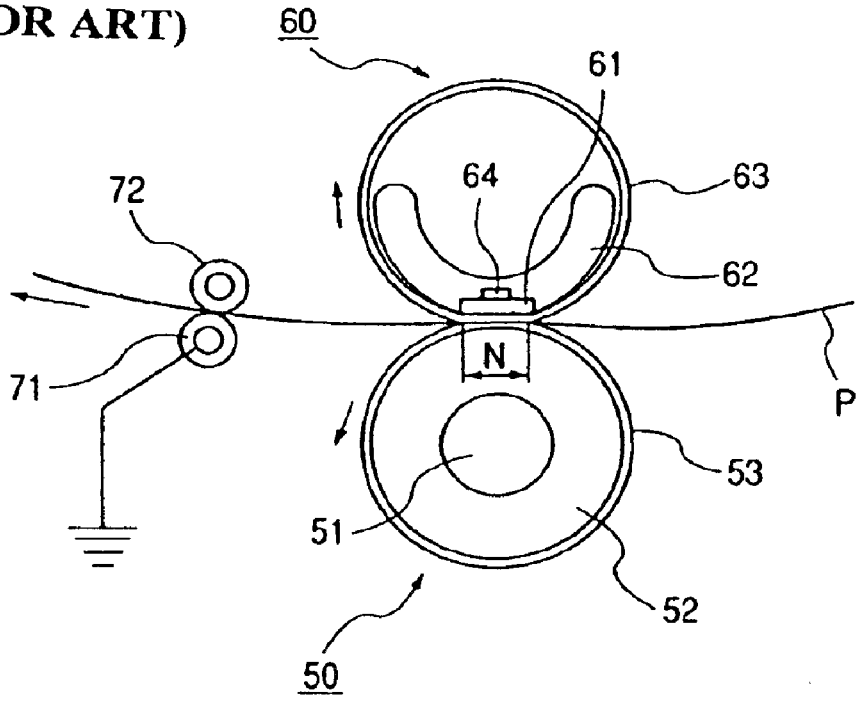
FIG. 11 (PRIOR ART)
FIG. 11 is a drawing schematically showing a conventional fixing apparatus (using a film heating scheme).
Figure 12:
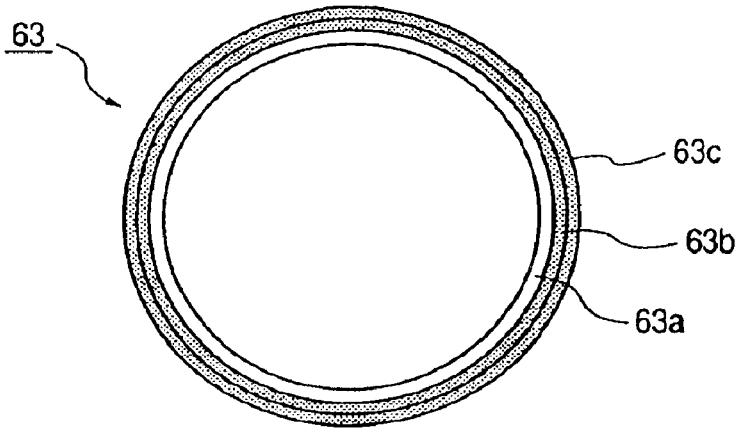
FIG. 12 (PRIOR ART)
FIG. 12 is a drawing showing a layer structure of a fixing film.
Figure 13:
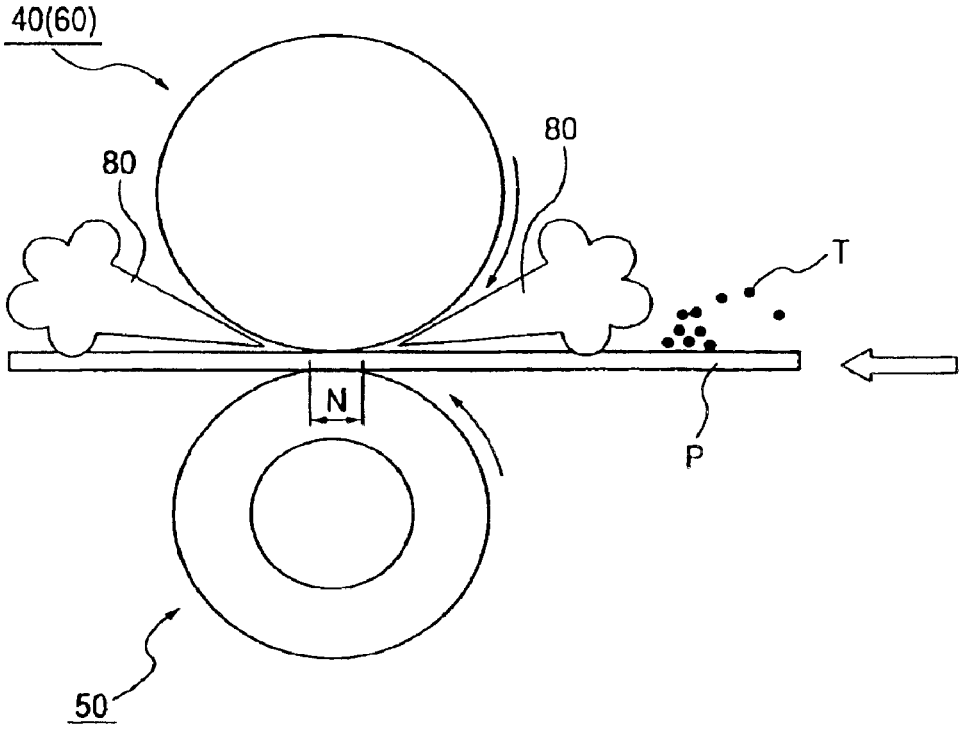
FIG. 13 (PRIOR ART)
FIG. 13 is a drawing for illustrating a mechanism of generation of smeared image trailing edge upon fixing in a conventional fixing apparatus.

This embodiment will be described in connection with the structure of the heat fixing apparatus shown in FIG. 7 and the timing chart shown in FIG. 9. In FIG. 7, fixing bias A with the polarity same as the toner is applied to the electro-conductive primer layer 13*b* of the fixing film 13 by the bias applying means 16, while fixing bias B with the polarity reverse to the toner is applied to the metal core 21 of the pressure roller 20 and the electro-conductive rubber discharge roller 25 disposed in the downstream of the fixing nip by the bias applying means 28. In that process, as shown in FIG. 9, the fixing bias A is applied with bias value Vf when a predetermined time has elapsed after detection of the leading edge of the recording material by the top sensor 8, that is just before the entrance of the leading edge of the recording material into the fixing nip portion N. On the other hand, the fixing bias B is applied with bias value Vb at substantially the same time as the fixing bias A, and when the leading edge of the recording material is detected by the discharged paper sensor 27 shown in FIG. 7, the bias value is changed to bias value Vp that is smaller than Vb.

In addition, in the case of consecutive printing, at least one of the above mentioned bias values Vf and Vp under the state in which the recording material P is in contact with the fixing nip portion N and the discharge roller 25 is gradually decreased in accordance with the number of recording materials that have been fixed, so that the electric potential difference between the electro-conductive primer layer 13*b* of the fixing film 13 and the electro-conductive member in the downstream of the fixing nip portion is decreased gradually or stepwise. Thus, the amount of the current flowing in a current path via the recording material is controlled.

With the above-described features, it is possible to realize satisfactory image formation while eliminating toner contamination of the fixing film 13 and the pressure roller 20 in the case of consecutive printing, as demonstrated in connection with the above-described first embodiment.

It is a feature of the present embodiment that an electric potential difference corresponding to the bias values Vf and Vb can be ensured for a portion of the image in the leading edge area that passes through the fixing nip no later than the leading edge of the recording material comes into contact with the electro-conductive member 25 disposed in the downstream of the fixing nip. Therefore, a force that bounds the unfixed toner image to the surface of the recording material is intensified and the smeared image trailing edge upon fixing can be improved in the leading edge area of the recording material.

In addition, since the commutating element 24 such as a diode is connected to the metal core 21 of the pressure roller, the electric potential of the metal core 21 of the pressure roller or the electro-conductive elastic layer 22 would not fall to a low potential immediately, even if the fixing bias B is switched from Vb to Vp. Therefore, an image error will not occur upon switching of the bias voltage from Vb to Vp.

In order to confirm improvement in the smeared image trailing edge upon fixing in the leading edge area of the recording material and to check the toner contamination on the fixing film and the pressure roller at that time, we checked them while varying the respective fixing biases Vf, Vb and Vp. The structure of the heat fixing apparatus used for this checking and the way of checking the toner contamination are the same as those in the first embodiment, and therefore the description thereof will be omitted.

As to the toner contamination, since we could foresee the situations to some extent based on the results obtained in the first embodiment, we divided and distributed the electric potential difference Vf in the first embodiment into two parts for the film side and for the pressure roller side, so that the common bias values were set for Vf and Vp as shown in Table 3. The definition of the consecutive printing is the same as that in the first embodiment. In addition, once the consecutive printing is stopped, the bias setting shown in Table 3 is returned to the setting for the first sheet.

TABLE 3

| Sheet Number | 1 to 20 | 21 to 50 | 51 to 80 | 81 to 500 |
|---|---|---|---|---|
| Vf | −500 V | −400 V | −300 V | −250 V |
| Vp | −500 V | −400 V | −300 V | −250 V |

Table 4 shows values of the bias Vb set for respective experiments 4 to 7 (Exp. 4 to Exp. 7)

TABLE 4

| Sheet Number | 1 to 20 | 21 to 50 | 51 to 80 | 81 to 500 |
|---|---|---|---|---|
| Exp. 4 | −500 V | −400 V | −300 V | −250 V |
| Exp. 5 | −500 V | −500 V | −500 V | −500 V |
| Exp. 6 | −800 V | −750 V | −700 V | −650 V |
| Exp. 7 | −1000 V | −1000 V | −1000 V | −1000 V |

Table 5 shows the results of evaluations of the smeared image trailing edge upon fixing under the condition that the biases were varied and the results of comparative evaluations of the toner contamination on the fixing film and the pressure roller in the consecutive printing.

TABLE 5

| | Results of Comparison on Smeared Image Trailing Edge in the Leading Edge Area | | | | Results of Comparison on |
|---|---|---|---|---|---|
| Sheet Number | first sheet | 21st sheet | 51st sheet | 81st sheet | Toner Contamination |
| Exp. 4 | 2 | 3 | 3 | 2 | 3 |
| Exp. 5 | 2 | 3 | 3 | 3 | 3 |
| Exp. 6 | 3 | 4 | 4 | 4 | 3 |
| Exp. 7 | 4 | 5 | 5 | 5 | 2 |

With the above results, it would be understood that in the state in which the leading edge of the recording material had not reached the electro-conductive rubber discharge roller 25 and there was no current path, the smeared image trailing edge upon fixing in the leading edge area of the recording material was not good, and even in experiment 4 in which the bias setting was the same as that in the first embodiment, the degree of the smeared image trailing edge upon fixing in the leading edge area was deteriorated by one rank as compared to the central area.

On the other hand, it would be understood that in the case that the electric potential difference between the electro-conductive primer layer 13*b* of the fixing film 13 and the electro-conductive-elastic layer of the pressure roller was kept to be large by increasing the bias value only in the leading edge, the smeared image trailing edge upon fixing was improved.

However, if the potential difference is kept too large even only in the leading edge, the toner contamination is deteriorated. This is because if the recording material is paper, paper powder is likely to adhere to the surface of the fixing film or the surface of the pressure roller at the edge of the paper sheet. Generally, in the case of cut paper, paper powder is apt to be generated at the edge portions of the paper sheet due to cutting. If a large amount of paper powder accumulates on the fixing film or the pressure roller, the surface releasability of the fixing film or the pressure roller is deteriorated and they become easy to be contaminated by toner.

In view of the above, if a moderate electric potential difference is given between the electro-conductive primer layer of the fixing film and the electro-conductive elastic layer or the pressure roller in the state in which the leading edge of the recording material is held and conveyed in the fixing nip and the leading edge of the recording material has not come into contact with the electro-conductive member disposed in the downstream of the fixing nip, it is possible to improve the smeared image trailing edge upon fixing in the leading edge area of the recording material without toner contamination on the surface of the fixing film or the surface of the pressure roller. Especially, if the above-mentioned electric potential difference is kept to be large as compared to the potential difference under the state in which the recording material is in contact with the electro-conductive member disposed in the downstream of the fixing nip, it is possible to prevent the situation that the smeared trailing edge upon fixing is made worse only in the leading edge area of the recording material.

While the present embodiment has been described with reference to a system in which biases are applied to the electro-conductive primer layer of the fixing film, the metal core and the electro-conductive elastic layer of the pressure roller and the electro-conductive rubber discharge roller, the bias applying system may be modified in various ways as long as the electric potential differences same as described above can be realized. Specifically, the bias applying system may take any form as long as the electric potential difference between the electro-conductive primer layer of the fixing film and the electro-conductive elastic layer of the pressure roller before the leading edge of the recording material comes into contact with the electro-conductive member disposed just after the fixing nip is set larger than the electric potential difference between the electro-conductive primer layer of the fixing film and the electro-conductive member under the state in which the recording material is in contact with the electro-conductive member.

Third Embodiment

In the following, a third embodiment will be described. The overall structure of the image forming apparatus is the same as the structure shown in FIG. 1 that has been described in connection with the first embodiment, and the structure of the heat fixing apparatus is the same as the structure shown in FIGS. 2, 3 and 4 that has been described in connection with the first embodiment. Therefore, description thereof will be omitted.

A characterizing feature of the third embodiment resides in that the set values of the fixing bias are changed depending on the environment of the image forming apparatus under operation.

Generally, the smeared image trailing edge upon fixing mentioned in the descriptions of the first and second embodiments tends to be made worse as the moisture content of the recording material in the form of paper increases. This can be easily expected from the process that the moisture content in paper is heated in the fixing nip portion and vaporized to blow the unfixed toner image on the recording material.

On the other hand, as to the toner contamination on a fixing member or a pressurizing member, electrostatic factors have significant importance. Especially, in a low humidity environment, toner is easy to be influenced by an electric field, and toner contamination is likely to occur.

In view of the above, in this embodiment, the image forming apparatus is provided with means for detecting an environmental factor(s) such as temperature and humidity, and set values for the fixing bias is varied depending on the environmental factor(s) and the fixing bias is gradually decreased in accordance with the number of the sheets under consecutive printing. Thus, there is provided a high quality image forming apparatus that does not suffer from the smeared image trailing edge upon fixing and the toner contamination.

In the following, the present embodiment will be described with reference to the heat fixing apparatus shown in FIG. 2 and the bias timing chart shown in FIG. 6, which have been referred to in connection with the first embodiment.

The image forming apparatus is provided with at least one of temperature detection means and humidity detection means serving as environment detection means to detect the environment in which the image forming apparatus is operated. In FIG. 2, reference numeral 101 designates the environment detection means. Environment information detected by the environment detection means is input to the control circuit part 100. The control circuit part 100 may classify the environment information detected by the environment detection means 101 into, for example, low humidity environment (which will be referred to as L/L environment hereinafter) in which the temperature is equal to or lower than 15° C. and the humidity is equal to or lower than 10% and high humidity environment (which will be referred to as H/H environment hereinafter) in which the temperature is equal to or higher than 30° C. and the humidity is equal to or higher than 80%. The intermediate condition between the L/L environment and the H/H environment is classified as normal humidity environment (which will be referred to as N/N environment hereinafter). In the L/L environment, since the smeared image trailing edge upon fixing is unlikely to occur, the bias is set in favor of the toner contamination. On the other hand, in the H/H environment, the bias is set in favor of the smeared image trailing edge upon fixing. Thus, both the smeared image trailing edge upon fixing and the toner contamination are prevented from occurring. In the N/N environment, medium bias setting between the bias setting for the L/L environment and the bias setting for the H/H environment is adopted.

In compliance with the above-described concept, upon operating the heat fixing apparatus shown in FIG. 2 in accordance with the bias timing chart shown in FIG. 6, the fixing bias Vf applied to the electro-conductive primer layer 13*b* of the fixing film 13 is set, for example, in the manner shown in Table 6.

TABLE 6

| Sheet Number | 1 to 20 | 21 to 50 | 51 to 80 | 81 and more |
|---|---|---|---|---|
| L/L environment | −600 V | −500 V | −400 V | −300 V |
| N/N environment | −1000 V | −800 V | −600 V | −500 V |
| H/H environment | −1400 V | −1200 V | −1000 V | −800 V |

Table 7 shows the results of evaluations performed on the smeared image trailing edge upon fixing and the toner contamination under the above bias setting for the respective environments. The structure of the image forming apparatus and the heat fixing apparatus used in the evaluations and the way of the evaluations are the same as those in the above-described first embodiment, and the description thereof will be omitted.

TABLE 7

| | Results of Evaluation on Smeared Image Trailing Edge upon Fixing | | | | Results of Evaluation on |
|---|---|---|---|---|---|
| Sheet Number | first sheet | 21st sheet | 51st sheet | 81st sheet | Toner Contamination |
| L/L Env. | 4 | 5 | 5 | 4 | 3 |
| N/N Env. | 3 | 4 | 4 | 3 | 3 |
| H/H Env. | 4 | 4 | 4 | 4 | 4 |

Besides the above, in a case in which printing was performed under an L/L environment with the bias setting for the N/N environment, the toner contamination level was as bad as rank 2. In addition, in a case which printing was performed under an H/H environment with the bias setting for the N/N environment, the level of the smeared image trailing edge upon fixing was as bad as rank 2.

Furthermore, in a case in which consecutive printing was performed under an L/L environment with a constant fixing bias of −600V, toner contamination was also deteriorated.

In view of these facts, the above method in which the bias values in the heat fixing apparatus are changed depending on the environment and the set bias values are gradually decreased in accordance with the number of sheets under consecutive printing is effective in improving the smeared image trailing edge upon fixing and the toner contamination in respective environments.

Fourth Embodiment

In the following, a fourth embodiment will be described. The overall structure of the image forming apparatus is the same as the structure shown in FIG. 1 that has been described in connection with the first embodiment, and the structure of the heat fixing apparatus is the same as the structure shown in FIGS. 2, 3 and 4 that has been described in connection with the first embodiment. Therefore, description thereof will be omitted.

A characterizing feature of the fourth embodiment resides in that in an image forming apparatus that has multiple recording material conveying speeds, the set values of the fixing bias are changed depending on the recording material conveying speed of the image forming apparatus.

Generally, the faster the recording material conveying speed is, the worse the smeared image trailing edge upon fixing that have been described in connection with the preceding embodiments becomes. This is easily expected from the fact that when the recording material enters the heat fixing apparatus, the recording material advances against the blow of vapor generated on the recording material entrance side (i.e. before the fixing nip) to enter the fixing nip, and that in the case that the conveying speed is made high, it is necessary to fuse the toner with a short heating time, and therefore the blow of vapor generated from the recording material is intensified.

On the other hand, in the case that the speed of the recording material is low, if an electric potential difference is set between the fixing member and the electro-conductive member disposed in the downstream of the fixing nip, the current flowing through the current path formed via the recording material is a little smaller than in the case in which the speed of the recording material is high under the same electric potential difference condition. However, the current amount in the case of the low recording material conveying speed is considerably large when considered in terms of its ratio to the recording material conveying speed.

Therefore, if a fixing bias optimized for a high recording material conveying speed is adopted in a case in which the conveying speed is low, an excessive current tends to flow, so that the offset and toner contamination would be deteriorated, though the smeared image trailing edge upon fixing would be improved.

On the other hand, in the field of image forming apparatus, there have been provided apparatus in which the conveying speed is varied depending on the type of recording material, or conveying speed of the recording material is varied upon changing the resolution of the toner image.

In view of the above-described situations, in the image forming apparatus that is capable of forming images at multiple recording material conveying speeds, it is necessary to setting optimum bias values in accordance with the respective recording material conveying speed in order to prevent the smeared trailing edge upon fixing from occurring. In addition, since a low recording material conveying speed is favorable as long as the smeared image trailing edge upon fixing is concerned, the lower the recording material conveying speed is, the smaller the bias reduction amounts for preventing both the smeared image trailing edge upon fixing and the toner contamination presented in the first embodiment and the second embodiment may be.

In view of the above, upon operating the heat fixing apparatus shown in FIG. 2 in accordance with the bias timing chart shown in FIG. 6, the fixing bias Vf applied to the electro-conductive primer layer 13*b* of the fixing film 13 is set, for example, in the manner shown in Table 8 depending on the respective recording material conveying speeds. We used an image forming apparatus having selectable recording material conveying speeds of 250 mm/esc and 125 mm/sec (i.e. the latter is half the former).

TABLE 8

| Sheet Number | 1 to 20 | 21 to 50 | 51 to 80 | 81 and more |
|---|---|---|---|---|
| 250 mm/sec | −1000 V | −800 V | −600 V | −500 V |
| 125 mm/sec | −600 V | −550 V | −500 V | −450 V |

Tables 9 and 10 show the conditions and results of evaluations performed on the smeared image trailing edge upon fixing and the toner contamination with the heat fixing apparatus shown in FIG. 2 under the above bias setting.

In Table 10, experiment 8 (Exp. 8) indicates the results of an experiment in which the recording materials were heat-fixed at the recording material conveying speed of 250 mm/sec under the bias setting for 250 mm/sec shown in Table 8, and experiment 9 (Exp. 9) indicates the results of an experiment in which the recording materials were heat-fixed at the recording material conveying speed of 125 mm/sec under the bias setting for 125 mm/sec shown in Table 8. In addition, experiments 10 and 11 (Exp. 10 and Exp. 11) indicate comparative experiments in which recording materials were heat-fixed at the 10 recording material conveying speed of 125 mm/sec under the bias setting shown in Table 9.

TABLE 9

| Sheet Number | 1 to 20 | 21 to 50 | 51 to 80 | 81 and more |
|---|---|---|---|---|
| Exp. 10 | −1000 V | −800 V | −600 V | −500 V |
| Exp. 11 | −600 V | −480 V | −360 V | −300 V |

TABLE 10

| | Results of Evaluation on Smeared Image Trailing Edge | | | | Results of Evaluation on |
|---|---|---|---|---|---|
| Sheet Number | first sheet | 21st sheet | 51st sheet | 81st sheet | Toner Contamination |
| Exp. 8 | 3 | 4 | 4 | 3 | 3 |
| Exp. 9 | 4 | 5 | 5 | 4 | 4 |
| Exp. 10 | 5 | 5 | 5 | 5 | 1 |
| Exp. 11 | 5 | 4 | 3 | 2 | 5 |

Besides the above, in a case in which consecutive printing was performed at the recording material conveying speed of 125 mm/sec with a constant fixing bias value of −600V, toner contamination of level 2 was generated, though the level of the smeared image trailing edge upon fixing was satisfactory.

As per the above results shown in the tables, in the case that the recording material conveying speed is low, it is possible to prevent the toner contamination without deteriorating the smeared image trailing edge upon fixing by setting the fixing bias low. However, if the fixing bias is made too low, the smeared image trailing edge upon fixing is made worse.

Furthermore, in the case that the recording material conveying speed is low, the smaller bias decrement (or stepping-down) amounts for consecutive printing from the bias set for the initial stage of the consecutive printing are optimal in relation to smeared image trailing edge upon fixing and toner contamination.

As per the above, in the image forming apparatus capable of setting multiple recording material conveying speeds, it is possible to prevent smeared image trailing edge upon fixing and toner contamination for each speed by providing bias applying means for setting the bias depending on the recording material conveying speed in such a way that the set bias value is gradually decreased in accordance with the recording material conveying speed and the number of sheets under consecutive printing, and setting the fixing bias decrement amount(s) for the case of a low recording material conveying speed lower than that for the case of a high recording material conveying speed.

(Others)

1) While the embodiments of the present invention have been described mainly with reference to the heat fixing apparatus provided with the fixing film 13, it is apparent that the present invention carries out the same effects even with a heat fixing apparatus using a heating roller, as long as it adopts a system in which a current path is formed between a fixing member and an electro-conductive member provided in the downstream of the fixing nip that is to be in contact with the recording material.

2) The heating process of the fixing member may be a heating process using electromagnetic induction.

3) The heat fixing apparatus using a film heating scheme according to the embodiments are of a type in which the film is driven by a rotating member for applying pressure. However, the apparatus may be modified to have a structure that a driving roller is provided on the inner circumferential surface of an endless fixing film so that the film is driven under a tensioned state, or a structure that a rolled film in the form of a web having ends is provided so that it is driven to run.

4) The image heating apparatus according to the present invention is not limited to the fixing apparatus for heat fixing an unfixed image on a recording material as a permanent image, but it includes other apparatus such as a heating apparatus for provisionally fixing an unfixed image on a recording material and a heating apparatus for re-heating a recording material bearing an image to change an image surface quality such as a gloss quality etc.

5) The image forming process of the image forming apparatus is not limited to the electrophotography process, but it may be an electrostatic recording process, a magnetic recording process etc. In addition, the image forming scheme may be either a transferring scheme or a direct scheme.

As has been described in the foregoing, according to the present invention, upon heat fixing recording materials consecutively, in the early stage of the consecutive fixing in which smeared image trailing edge upon fixing is likely to occur, a current path is formed between a fixing member and an electro-conductive member disposed in the downstream of the fixing nip via a recording material, so that bounding force of the unfixed toner image on the recording material is enhanced by an electric field generated by voltage drop between an electro-conductive part of the fixing member and the recording material. Therefore, it is possible to prevent the smeared image trailing edge upon fixing from occurring.

In addition, in the later stage of the consecutive fixing, the current amount flowing the above-mentioned current path is decreased by reduction of the fixing bias, so that contamination of the fixing member or a pressurizing member with toner due to toner offset that might occur if the toner charge polarity is reversed by charge injection into the toner just after the fixing nip due to excessive current flow.

What is claimed is:

1. A heat fixing apparatus comprising:

a fixing member;

a pressurizing member in pressure contact with said fixing member to form a fixing nip for holding and conveying a recording material on which an unfixed image has been formed so that said unfixed image formed on the recording material would be fixed as a permanent image;

an electro-conductive member to be in contact with the recording material disposed downstream of said fixing nip with respect to a recording material conveying direction;

bias applying means for applying a variable bias voltage to at least one of said fixing member and said electro-conductive member; and bias control means that varies, in the case that recording materials on which unfixed images have been formed are consecutively fed, the bias voltage applied by said bias applying means gradually or stepwise while the recording materials are passing.

2. A heat fixing apparatus according to claim 1, wherein, in the case that a state in which feeding of a succeeding recording material has already been started by feeding means of an image forming apparatus at a time when a trailing edge of a preceding recording material passes a portion of the fixing nip, said bias control means determines that the recording materials are consecutively fed and decreases the bias voltage to be applied while the recording materials are passing gradually or stepwise.

3. A heat fixing apparatus according to claim 2, wherein in an intervening period between the preceding recording material and the succeeding recording material during which the fixing member and the pressurizing member are in direct contact without a recording material therebetween, said bias control means turns the bias voltage off.

4. A heat fixing apparatus according to claim 2, wherein said bias applying means includes at least one of means for applying a bias voltage with a same polarity as that of toner to an electro-conductive part of the fixing member and means for applying a bias voltage with a polarity reverse to that of toner to an electro-conductive part of the pressurizing member, at least one of said means being capable of varying the bias voltage, and an electric potential difference between the electro-conductive part of the fixing member and the electro-conductive part of the pressurizing member before a leading edge of the recording material comes into contact with the electro-conductive member disposed downstream of the fixing nip with respect to the recording material conveying direction is larger than the electric potential difference between the electro-conductive part of the fixing member and the electro-conductive part of the pressurizing member while the recording material is in contact with said electro-conductive member.

5. A heat fixing apparatus according to claim 2, wherein the heat fixing apparatus is applied to an image forming apparatus capable of setting a plurality of recording material conveying speeds, the bias applying means applies the bias voltage in such a way that an electric potential difference between an electro-conductive part of the fixing member and the electro-conductive member disposed downstream of the fixing nip is smaller when a low conveying speed is set than when a high conveying speed is set, and a decrement amount of the bias voltage, which is varied in accordance with a number of heated recording materials in the case that a state in which feeding of a succeeding recording material has been started by feeding means of the image forming apparatus when a trailing edge of a preceding recording material passes the fixing nip portion continues, is smaller when a low conveying speed is set than when a high conveying speed is set.

6. A heat fixing apparatus according to claim 1, wherein said pressurizing member has an electro-conductive part, to which a commutating element is connected so that the electro-conductive part would be kept to have polarity reverse that of toner.

7. A heat fixing apparatus according to claim 1, wherein the heat fixing apparatus is applied to an image forming apparatus provided with environment detection means for detecting at least one of temperature and humidity of operation environment, and said bias control means controls the bias voltage applied by the bias applying means based on a detection result of said environment detection means.

8. A heat fixing apparatus according to claim 1, wherein the heat fixing apparatus is applied to an image forming apparatus capable of setting a plurality of recording material conveying speeds, and said bias control means controls the bias voltage applied by the bias applying means in accordance with the recording material conveying speed that is set.

9. A heat fixing apparatus according to claim 1, wherein in the case that more than a predetermined number of recording materials are fed consecutively, said bias control means has a constant bias voltage applied to a recording material that is fed after said predetermined number of recording materials.

10. A heat fixing apparatus according to claim 1, wherein the heating apparatus uses either a heating roller scheme or a film heating scheme.

11. An image forming apparatus comprising:

an image forming part that forms an unfixed image on a recording material;

a fixing member;

a pressurizing member in pressure contact with said fixing member to form a fixing nip for holding and conveying the recording material on which the unfixed image has been formed by said image forming part so that said unfixed image formed on the recording material would be fixed as a permanent image;

an electro-conductive member to be in contact with the recording material disposed downstream of said fixing nip with respect to a recording material conveying direction;

bias applying means for applying a variable bias voltage to at least one of said fixing member and said electro-conductive member; and bias control means that varies, in the case that recording materials on which unfixed images have been formed are consecutively fed, the bias voltage applied by said bias applying means gradually or stepwise while the recording materials are passing.

12. An image forming apparatus according to claim 11, wherein in the case that a state in which feeding of a succeeding recording material has already been started by feeding means of an image forming apparatus at a time when a trailing edge of a preceding recording material passes a portion of the fixing nip, said bias control means determines that the recording materials are consecutively fed and decreases the bias voltage to be applied while the recording materials are passing gradually or stepwise.

13. An image forming apparatus according to claim 12, wherein in an intervening period between the preceding recording material and the succeeding recording material during which the fixing member and the pressurizing member are in direct contact without a recording material therebetween, said bias control means turns the bias voltage off.

14. An image forming apparatus according to claim 12, wherein said bias applying means includes at least one of means for applying a bias voltage with a same polarity as that of toner to an electro-conductive part of the fixing member and means for applying a bias voltage with a polarity reverse to that of the toner to an electro-conductive part of the pressurizing member, at least one of said means being capable of varying the bias voltage, and an electric potential difference between the electro-conductive part of the fixing member and the electro-conductive part of the pressurizing member before a leading edge of the recording material comes into contact with the electro-conductive member disposed downstream of the fixing nip with respect to the recording material conveying direction is larger than the electric potential difference between the electro-conductive part of the fixing member and the electro-conductive part of the pressurizing member while the recording material is in contact with said electro-conductive member.

15. An image forming apparatus according to claim 12, wherein said image forming part is capable of setting a plurality of recording material conveying speeds, the bias applying means applies the bias voltage in such a way that an electric potential difference between an electro-conductive part of the fixing member and the electro-conductive member disposed downstream of the fixing nip is smaller when a low conveying speed is set than when a high conveying speed is set, and a decrement amount of the bias voltage, which is varied in accordance with a number of heated recording materials in the case that a state in which feeding of a succeeding recording material has been started by feeding means of the image forming apparatus when a trailing edge of a preceding recording material passes the fixing nip portion continues, is smaller when a low conveying speed is set than when a high conveying speed is set.

16. An image forming apparatus according to claim 11, wherein said pressurizing member has an electro-conductive part, to which a commutating element is connected so that the electro-conductive part would be kept to have a polarity reverse to that of toner.

17. An image forming apparatus according to claim 11, wherein said image forming part is provided with environment detection means for detecting at least one of temperature and humidity of operation environment, and said bias control means controls the bias voltage applied by the bias applying means based on a detection result of said environment detection means.

18. An image forming apparatus according to claim 11, wherein said image forming part is capable of setting a plurality of recording material conveying speeds, and said bias control means controls the bias voltage applied by the bias applying means in accordance with the recording material conveying speed that is set.

19. A heat fixing apparatus comprising:

a fixing member;

a pressurizing member in pressure contact with said fixing member to form a fixing nip for holding and conveying a recording material to fix an unfixed image formed on the recording material;

an electro-conductive member contactable with the recording material downstream of said fixing nip with respect to a recording material conveying direction;

a bias applying circuit for applying a variable bias voltage to at least one of said fixing member and said electro-conductive member; and a bias controller that varies the bias voltage applied by said bias applying circuit gradually or stepwise while recording materials are consecutively conveyed.

20. A heat fixing apparatus according to claim 19, wherein, in a case where a succeeding recording material is fed before a trailing edge of a preceding recording material passes a portion of the fixing nip, said bias controller determines that the recording materials are consecutively conveyed and decreases the bias voltage gradually or stepwise.

21. A heat fixing apparatus according to claim 20, wherein in an intervening period between the preceding recording material and the succeeding recording material during which the fixing member and the pressurizing member are in direct contact without a recording material therebetween, said bias controller turns the bias voltage off.

22. A heat fixing apparatus according to claim 20, wherein said bias applying circuit includes at least one of a circuit for applying a bias voltage with a same polarity as that of toner to an electro-conductive part of the fixing member and a circuit for applying a bias voltage with a polarity reverse to that of toner to an electro-conductive part of the pressurizing member, at least one of said circuits being capable of varying the bias voltage, and an electric potential difference between the electro-conductive part of the fixing member and the electro-conductive part of the pressurizing member before a leading edge of the recording material comes into contact with the electro-conductive member disposed downstream of the fixing nip with respect to the recording material conveying direction is larger than the electric potential difference between the electron-conductive part of the fixing member and the electro-conductive part of the pressurizing member while the recording material is in contact with said electra-conductive member.

23. A heat fixing apparatus according to claim 20, wherein the heat fixing apparatus is applied to an image forming apparatus capable of setting a plurality of recording material conveying speeds, the bias applying circuit applies the bias voltage in such a way that an electric potential difference between an electro-conductive part of the fixing member and the electro-conductive member disposed downstream of the fixing nip is smaller when a low conveying speed is set than when a high conveying speed is set, and a decrement amount of the bias voltage, when the recording materials are consecutively conveyed, is smaller when a low conveying speed is set than when a high conveying speed is set.

24. A heat fixing apparatus according to claim 19, wherein said pressurizing member has an electro-conductive part, to which a commutating element is connected so that the electro-conductive part is kept at a polarity reverse to that of toner.

25. A heat fixing apparatus according to claim 19, wherein the heat fixing apparatus is applied to an image forming apparatus provided with an environment detector for detecting at least one of temperature and humidity of an operation environment, and said bias controller controls the bias voltage applied by the bias applying circuit based on a detection result of said environment detector.

26. A heat fixing apparatus according to claim 19, wherein the heat fixing apparatus is applied to an image forming apparatus capable of setting a plurality of recording material conveying speeds, and said bias controller controls the bias voltage applied by the bias applying circuit in accordance with the set recording material conveying speed.

27. A heat fixing apparatus according to claim 19, wherein in the case where more than a predetermined number of recording materials are fed consecutively, said bias controller has a constant bias voltage applied to a recording material that is fed after said predetermined number of recording materials.

28. A heat fixing apparatus according to claim 19, wherein the heating apparatus uses one of a heating roller scheme and a film heating scheme.

29. An image forming apparatus comprising:

an image forming unit that forms an unfixed image on a recording material;

a fixing member;

a pressurizing member in pressure contact with said fixing member to form a fixing nip for holding and conveying the recording material to fix the unfixed image formed on the recording material;

an electro-conductive member contactable with the recording material disposed downstream of said fixing nip with respect to a recording material conveying direction;

a bias applying circuit for applying a variable bias voltage to at least one of said fixing member and said electro-conductive member; and a bias controller that varies the bias voltage applied by said bias applying circuit gradually or stepwise while the recording materials are consecutively conveyed.

30. An image forming apparatus according to claim 29, wherein in a case where a succeeding recording material is fed before a trailing edge of a preceding recording material passes a portion of the fixing nip, said bias controller determines that the recording materials are consecutively conveyed and decreases the bias voltage gradually or stepwise.

31. An image forming apparatus according to claim 30, wherein in an intervening period between the preceding recording material and the succeeding recording material during which the fixing member and the pressurizing member are in direct contact without a recording material between, said bias controller turns the bias voltage off.

32. An image forming apparatus according to claim 30, wherein said bias applying means includes at least one of a circuit for applying a bias voltage with a same polarity as that of toner to an electro-conductive part of the fixing member and a circuit for applying a bias voltage with a polarity reverse to that of toner to an electro-conductive part of the pressurizing member, at least one of said circuits being capable of varying the bias voltage, and an electric potential difference between the electro-conductive part of the fixing member and the electro-conductive part of the pressurizing member before a leading edge of the recording material comes into contact with the electro-conductive member disposed downstream of the fixing nip with respect to the recording material conveying direction is larger than the electric potential difference between the electro-conductive part of the fixing member and the electro-conductive part of the pressurizing member while the recording material is in contact with said electro-conductive member.

33. An image forming apparatus according to claim 30, wherein said image forming unit is capable of setting a plurality of recording material conveying speeds, the bias applying circuit applies the bias voltage in such a way that an electric potential difference between an electro-conductive part of the fixing member and the electro-conductive member disposed downstream of the fixing nip is smaller when a low conveying speed is set than when a high conveying speed is set, and a decrement amount of the bias voltage, when the recording materials are consecutively conveyed, is smaller when a low conveying speed is set than when a high conveying speed is set.

34. An image forming apparatus according to claim 29, wherein said pressurizing member has an electro-conductive part, to which a commutating element is connected so that the electro-conductive part would be kept to have a polarity reverse to that of toner.

35. An image forming apparatus according to claim 29, wherein said image forming unit is provided with an environment detector for detecting at least one of temperature and humidity of an operation environment, and said bias controller controls the bias voltage applied by the bias applying circuit based on a detection result of said environment detector.

36. An image forming apparatus according to claim 29, wherein said image forming unit is capable of setting a plurality of recording material conveying speeds, and said bias controller controls the bias voltage applied by the bias applying circuit in accordance with the set recording material conveying speed.

* * * * *

UNITED STATES PATENT AND TRADEMARK OFFICE

CERTIFICATE OF CORRECTION

PATENT NO. : 6,915,099 B2
DATED : July 5, 2005
INVENTOR(S) : Satoru Izawa et al.

It is certified that error appears in the above-identified patent and that said Letters Patent is hereby corrected as shown below:

Column 10,
Line 9, “a insulative” should read -- an insulative --.

Column 29,
Line 37, “electra-condctive” should read -- electro-conductive --.

Signed and Sealed this

First Day of November, 2005

JON W. DUDAS
*Director of the United States Patent and Trademark Office*